US010143283B1

(12) United States Patent
Daneshvar

(10) Patent No.: US 10,143,283 B1
(45) **Date of Patent: *Dec. 4, 2018**

(54) DANESHVAR DIFFRENTIAL HAIR COLORING AND METHODS III

(71) Applicant: Yousef Daneshvar, West Bloomfield, MI (US)

(72) Inventor: Yousef Daneshvar, West Bloomfield, MI (US)

(73) Assignee: AMERICAN MEDICAL CORPORATION, West Bloomfield, MI (US)

( * ) Notice: Subject to any disclaimer, the term of this patent is extended or adjusted under 35 U.S.C. 154(b) by 208 days.

This patent is subject to a terminal disclaimer.

(21) Appl. No.: 14/551,063

(22) Filed: Nov. 23, 2014

Related U.S. Application Data

(63) Continuation of application No. 13/910,095, filed on Jun. 4, 2013, now abandoned, and a continuation-in-part of application No. 11/717,529, filed on Mar. 13, 2007, now Pat. No. 9,204,701.

(60) Provisional application No. 61/689,542, filed on Jun. 8, 2012, provisional application No. 60/783,764, filed on Mar. 20, 2006.

(51) Int. Cl.

| | |
|---|---|
| ***A45D 24/16*** | (2006.01) |
| ***A45D 19/00*** | (2006.01) |
| ***A46B 11/00*** | (2006.01) |
| ***A46B 9/06*** | (2006.01) |

(52) U.S. Cl.
CPC ..... *A45D 19/0008* (2013.01); *A46B 9/06* (2013.01); *A46B 11/0065* (2013.01); *A45D 2019/0066* (2013.01)

(58) Field of Classification Search
CPC ..... A45D 19/0008; A45D 2019/0066; A45D 24/22; A46B 9/06; A46B 11/0065
See application file for complete search history.

(56) References Cited

U.S. PATENT DOCUMENTS

| | | | | |
|---|---|---|---|---|
| 5,819,960 | A * | 10/1998 | Bonazza | A47F 3/142 211/133.1 |
| 5,915,390 | A * | 6/1999 | Daughtry | A45D 19/02 132/112 |
| 7,322,365 | B2 * | 1/2008 | Kelloyan | A45D 19/02 132/200 |
| 8,215,318 | B2 * | 7/2012 | Jacob | A45D 19/02 132/202 |
| 2007/0205129 | A1 * | 9/2007 | Kipry | A45D 19/00 206/503 |

* cited by examiner

*Primary Examiner* — Rachel Steitz

(57) ABSTRACT

Coloring of hairs are commonly done for various reasons. Commonly, a single hair dye is applied which leaves a uniform coloring of the hairs. However, many prefer having shades of hair coloring or two different coloring. Thus in this application methods and means are introduced that allows a differential coloring to be possible. In this method a hand held brush means allows a predicted amount of the hair dye to be carried to the hairs and applied. Also a special dye pan allows a predicted amount of hair dye to be applied to the brush units to make such goals possible.

21 Claims, 15 Drawing Sheets

DANESHVAR DIFFRENTIAL HAIR COLORING AND METHODS III

This application claims priority of pending non-provisional application Ser. No. 13/910,095, filed Jun. 4, 2013, which claims priorities of provisional Application No. 61/689,542, filed Jun. 8, 2012, and pending non-provisional application Ser. No. 11/717,529, filed Mar. 13, 2007, which claims priority of provisional Application No. 60/783,764, filed Mar. 20, 2006.

THE BACK GROUND OF THE INVENTION

Coloring of hairs are common for reasons such as beautification, religious beliefs and expression of choices. Commonly, one colored hair dye is applied to the hairs which leave a uniform color of the hairs. However, in many conditions coloring of the hairs uniformly with one color is not ideal, for example when the person wishes to have shades of a hair color to match the changes that happens with age, which then a uniform color will not be desired. Also in a circumstance when a person wishes to have a more artistic hair coloring a uniform hair coloring will not be ideal. For these reasons this application introduces methods and means that allow differential coloring of hairs to be possible in a living body. In this subject, also other related issues will be also addressed for example the process of coloring the hairs needs to be advanced to remove certain difficulties. The applicant has a pending application and now he wishes to add some more details to previous application.

BRIEF EXPLANATION OF THIS INVENTION

In this application the applicant introduces a special, hand hold brush means that allows a predicted amount of hair dye to be carried from a special pan to the hairs for being applied. This, special brush means has a series of brush units that are capable of holding and carrying a predicted amount of the hair dye from a source for being delivered to the hairs without significant dripping and contaminating the surrounding. This method provides multiple advantages, first, it allows the application of the dye to the hair to be easy, and second, it allows some groups of the hairs to be spared from being dyed. Third, it also allows some of the hair dye which was already applied to the hairs to be removed, thus finally the hairs will have different groups, some which has received full dose of the hair dye and others with much lesser or no hair dye and a third group which has different shades of the hair dye on them. Thus at the end this method allows the hairs to have multiple shades of the hair dye on them and look different than having a solid uniform coloring. Also it introduces methods and means for application of dye to limited areas of hairs. This application also allows two or more hair dyes to be applied at one time for creation of different over all hair coloring. Lastly, in this method the contamination of the surrounding by the dye will be very little and the use of hair dyes will be reduced significantly.

BRIEF EXPLANATION OF THE FIGURES

FIG. 24. Shows a thin sleeve for going over the handle shown in FIGS. 2, 4, 21 or similar.

FIG. 10. Shows the side view of a brush unit with a stem consisting of combination of two stems with a distance between.

DETAILED EXPLANATION OF THE FIGURES

Figure 1:
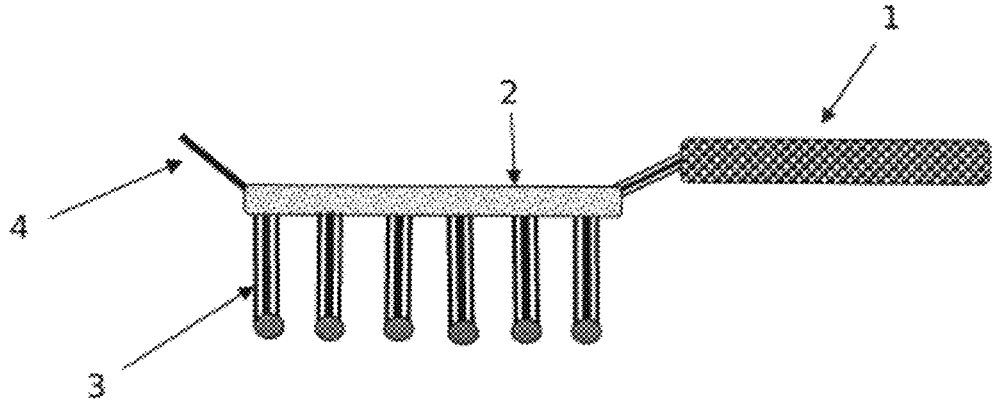
FIG. 1. Shows a brush means designed for carrying a predicted amount of the hair dye.

FIG. 1. Shows schematically a special brush means, (SBM) that consists of a base, 2 which is similar to the body of a commonly used hair brush and is designed for holding a series of special brush units, 3 on its surface. The brush units, 3 are designed for holding and carrying a predicted amount of a hair dye and are shown in more details in FIGS. 9-11. This brush unit has a handle, 1 similar to the handle of commonly used hair brushes for holing in the hand. Also it has an optional blade means, 4 in its end which is designed for mixing and wiping of a hair dye after the hair dye is poured inside a special space referred as the dye pan, 7 shown in FIG. 2. The purpose of this brush means is to allow its brush units, 3 to be dipped in a pan which has hair dye and to carry a predicted amount of the hair dye for application on the hairs.

Figure 2:
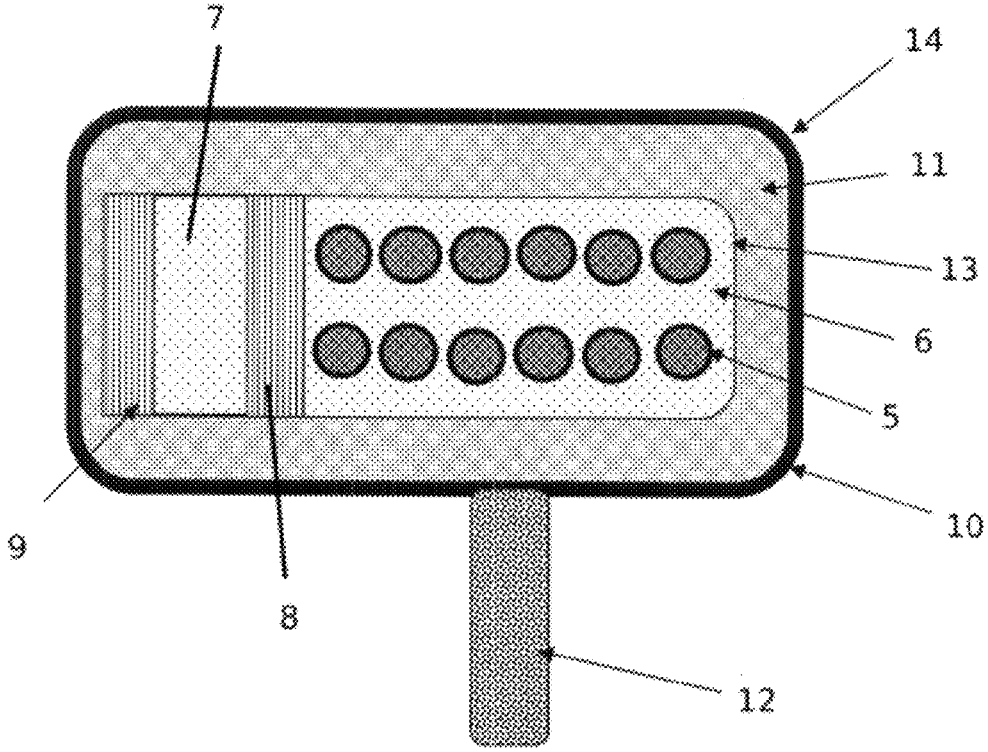
FIG. 2. Shows a tray means that allows a predicted amount of dye to be attached to the brush means of the unit shown at FIG. 1.
Figure 4:
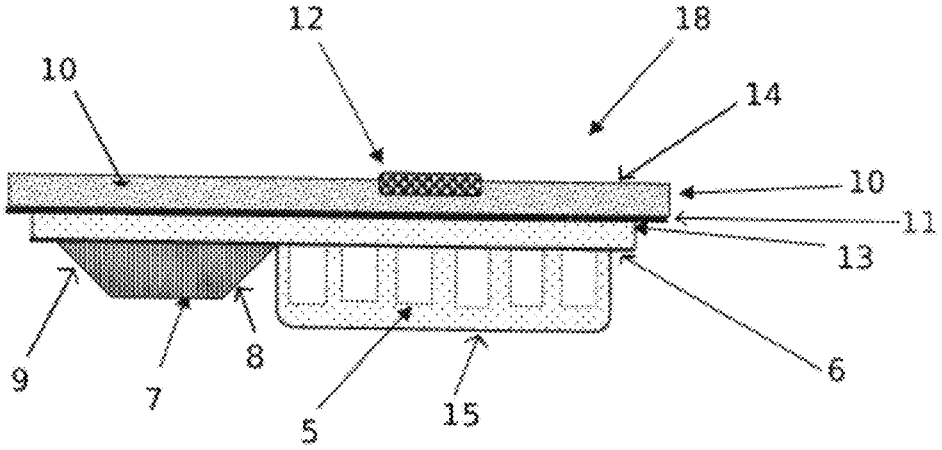
FIG. 4. Shows a cross cut view of the dye delivery tray means shown at FIG. 2.

FIG. 2. Shows schematically a special tray means designed for holding and mixing of a hair dye for being used by the brush means shown at FIG. 1. This unit consists of the following parts.

a. A series of cylindrical shaped empty spaces, 5 designed for holding a special amount of hair dye and allowing only one brush unit, 3 of the brush means shown at FIG. 1 to be inserted into only of these cylindrical spaces 5 for being immersed inside the dye when the dye has been poured into these spaces. So that each brush unit, 3 will enter into a matching single cylindrical space, 5 which is filled with dye. Thus when the brush means is removed from the pain means shown at FIG. 2 each brush unit, 3 will be covered with a predesigned amount of the hair dye, some may have more and some may have less or each one may have equal amount of dye as the user wish. Thus, the numbers of the cylindrical spaces, 5 and their locations will match the numbers and the locations of the brush units, 3 from the brush means shown at FIG. 1.

b. A first floor, 6 which is a flat layer with a flat surface, designed for holding the cylindrical spaces, 5 and the upper border or the edge of the cylindrical spaces is in the same level as the floor, 6. So that the hair dye can be moved to the surface of the flat layer and be moved to fill the cylindrical spaces.

c. The front part of the first floor, 6 has a relatively small pan referred as the 7 designed to allow a hair dye to be poured inside this small space for being prepared and used. This space, 7 has a front and a rear flat surfaces, which are like ramps, Ramp 1, 8 and Ramp 2, 9 9. The Ramp 1, 8 is essential and is located between the rear border of the dye pan, 7 and the front border of the first floor, 6. The 9, is located between the front border of the dye pan, 7 and the first floor, 6 as shown these ramps allows the blade, 4 of the brush unit shown at FIG. 1 to pull or wipe the dye from the dye pan, 7 to the surface of the flat surface, 6 and pulling the dye farther for filling the cylindrical spaces, 5. Please note the ramp two, 9 is not essential and may not exist in all such units.

d. A second, flat floor, 11 is designed to stand one level above the first floor, 6 and it has a surrounding wall or a side wall, 10.

e. The surrounding wall, or side wall, 10 is a vertically located wall which is attached vertically to the edge or the border of the second floor, 11, so that it will prevent the dye from being spilled out of the surface of the second floor, 11, this wall is also shown at FIG. 4. Importantly, the sizes and relative sizes and the thickness of these parts may vary for making a particular model.

f. A handle means, 12 is designed for allowing this unit to be hold by a hand comfortably, this handle is attached to one of the side walls, 10 or the bottom floor of this unit or to any desired location of this unit so that it allows the unit to be held by hand in a comfortable and steady position. Importantly, please note that although the use of only one brush unit, 3 of the brush means shown at FIG. 1 is emphasized for being inserted inside only one of these cylindrical spaces however, one may choose to have two or more brush units adjacent to each other in order for being immersed inside the one larger cylindrical space, 5 in order for being covered with the dye. Thus in practice those two of three brush units will in fact function as a single unit for this purpose. Importantly, the brush unit shown at FIG. 10 has two stems going to one cylindrical space, 5 except it has one round heard, RD, however, it is easy to consider that each one stem may have its own round head as well or the brush unit to have three or more stems which will inter into one cylindrical space, 5.

Figure 3:
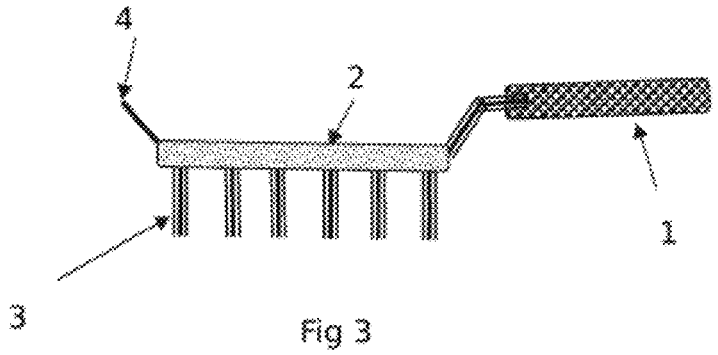
FIG. 3. Shows a brush means similar to the unit shown at FIG. 1 for use with the dye delivery tray means, shown at FIG. 4.

FIG. 3. Shows schematically a brush means similar to the unit shown at FIG. 1 which is designed to match and be used with the dye delivery tray means, shown at FIG. 4. So that at the time of use each brush unit, 3 of this brush means will dip into one of the matching small cylinderal space 5, of the pan in order to receive special amount of the hair dye.

FIG. 4. Shows schematically the side view of the dye delivery tray means similar to the model shown at FIG. 2. This figure shows the two pans, Pan1 shown at 13 and pan2 shown at 14 which are made by having a vertical wall means around the horizontal first and second floors means, 6 and 11 respectively. So that the vertical walls will prevent from the dye inside them from spilling out of these pans. The upper level or the edge of the cylindrical spaces, 5 are attached to the flat surface of the first floor, FLI. In this model as mentioned each cylindrical space allows one brush unit, 3 of the brush means shown at FIG. 3 to be inserted inside these cylindrical spaces in order to be immersed in the dye which will be poured inside these spaces. The second pan means, Pan2 shown at 14 stands above the first pan means 1, shown at 13 and has its own vertical wall, referred as 10.

The handle means, 12 is attached to the side of the Pan2 shown at 14. The front part of the first floor 6 has the dye pan, 7 with the adjacent ramps, allowing the blade, 4 from the brush unit shown in FIG. 3 to swipe the dye from the dye pan up to the surface of the first floor 6 for filling the cylindrical spaces, 5. Importantly, the unit shown in FIG. 4 will be made from a relatively rigid and durable body such as metal or synthetic hard material, so that will be strong and sturdy. Importantly, even though this unit may be used alone however, preferably it will be designed for being used as a cradle for placement of a disposable matching insert. The base, 15 is a body which has the series of the small cylindrical spaces shown at 5 to be made and the side walls of the small cylindrical spaces, 5 attaches to the floor one shown at 6. The opening 18 allows the pans to be accessed or the insert shown at FIG. 5 to be seated inside this durable unit. shown at FIG. 5.

Figure 5:
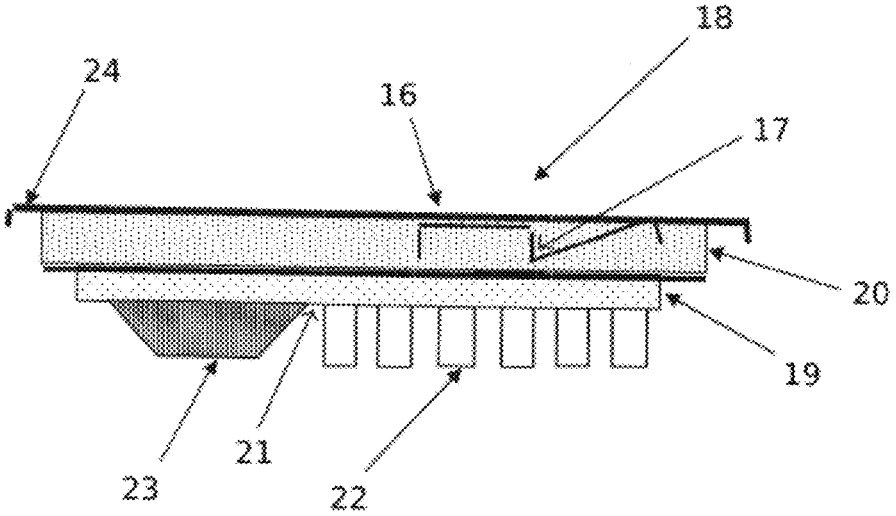
FIG. 5. Shows a disposable insert that fits inside the durable cradle shown at FIG. 4.

FIG. 5. Shows schematically a disposable insert, made from a thin polymer which has a body, a size and the engineering make up which matches and fits inside the durable cradle unit shown at FIG. 4. Thus the shape of the outer or the lower surface of this insert will be almost exactly matching unit similar to the shape of the inner/upper surface of the durable unit shown in FIG. 4, except it will be a shade smaller so that it will allow the placement of the insert inside or on top of the cradle shown at FIG. 4 to occur. Thus due to its all over thin body the shape of the inner surface of the cradle will be approximately the same as it's outside. This insert will have an edge, shown at 24 which will overlap the outer side wall, 10 of the body of durable unit shown at FIG. 4 so that it will sit and cover it for the purpose of preventing from the contamination of the edge of the durable unit with the dye. This disposable insert will function as follows.

1. It makes the use of these units easier and will save time and money, since the user does not need to use water for washing the cradle unit shown at FIG. 4.
2. It makes these units economical, since a thin disposable liner piece will be cheap and affordable.
3. It will make the units clean and hygienic, since this thin disposable liner will be disposed after use thus will eliminate or significantly decrease the spread of germs and diseases.
4. In a place that units may be used in different people, such as hair salons it will provide piece of mind for the costumers when they know that a new unit is used for them alone.

These inserts=liners simply matches the inside surface of the hard unit shown at FIG. 4 and will simply fit inside. A unit for covering the handle called handle cover shown at 16 will go over the handle and has a door means hinged to it, so that it will cover the lower surface of the handle and snap to its own wall so that even the handle part will be covered as well. Each part of this unit has a matching piece that will fit the parts of the unit shown at FIG. 4. Importantly, it is possible for the cradle to shown at FIG. 4 to have a common open space for the cylindrical spaces, shown at 5 to sit or to have only shallow spaces to allow only the outer ends of the cylindrical spaces to sit inside and be secure. Without jiggling and moving. The outer wall of this insert unit shown at FIG. 5 will overlap and cover the side wall, 10 of the pan 2 shown at 14 from the unit shown at FIG. 4.

Figure 6:
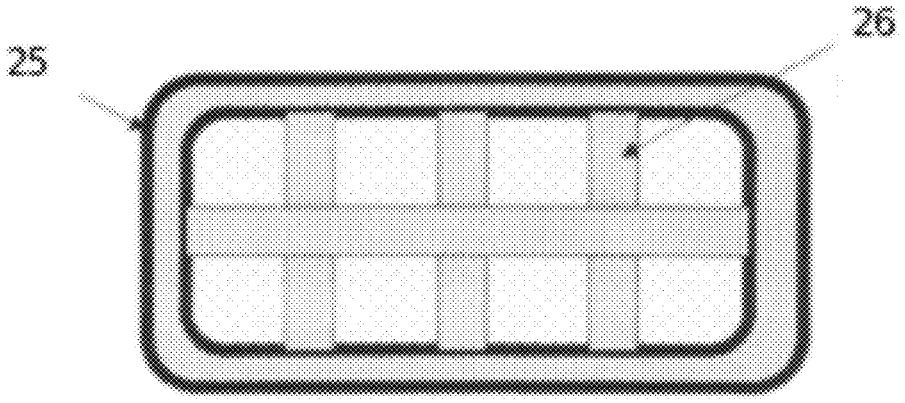
FIG. 6. Shows top view of a dye pan made by dividing a pan into small spaces by use of walls.

FIG. 6 shows schematically the top view of a simpler dye pan, which is a pan 25 with dividing walls, 26 making a series of small spaces which will accept a matching brush unit. This figure is to illustrate that other sorts of dye pans may be made for use. Although the model shown at FIG. 2 has the advantage which with use the cylindrical spaces, 5 the dye can be used with the smallest amount needed.

Figure 19:
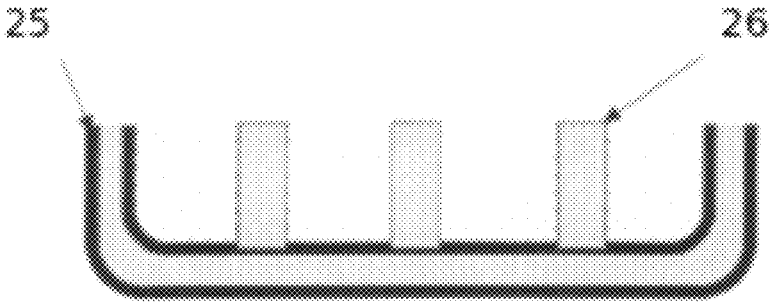
FIG. 19. Shows the cross cut view of the dye pan means, 25 shown in previous FIG. 6.

FIG. 19 shows schematically the cross cut view of the dye pan means, 26 shown in previous FIG. 6. In this view the small spaces are shown made by use of walls, 26.

Figure 20:
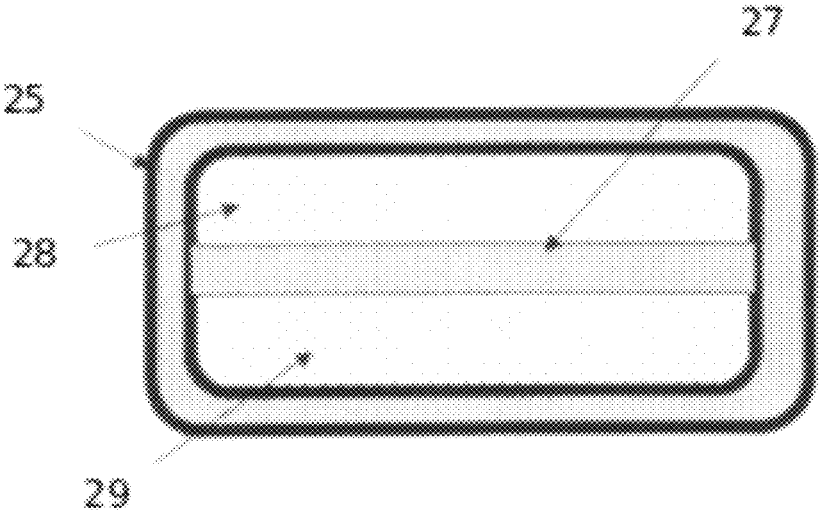
FIG. 20. Shows a dye pan means, 25 Pan divided to two sharing pans by a wall.

FIG. 20 shows schematically a dye pan means, 25 which is similar to unit shown in previous FIG. 6. except in this model the body of dye pan is divided to two sharing pans as shown so that one group of brush units will fit into one side of this pan, shown at 28 and the other group will fit inside the other side of the pan, shown at 29.

Figure 21:
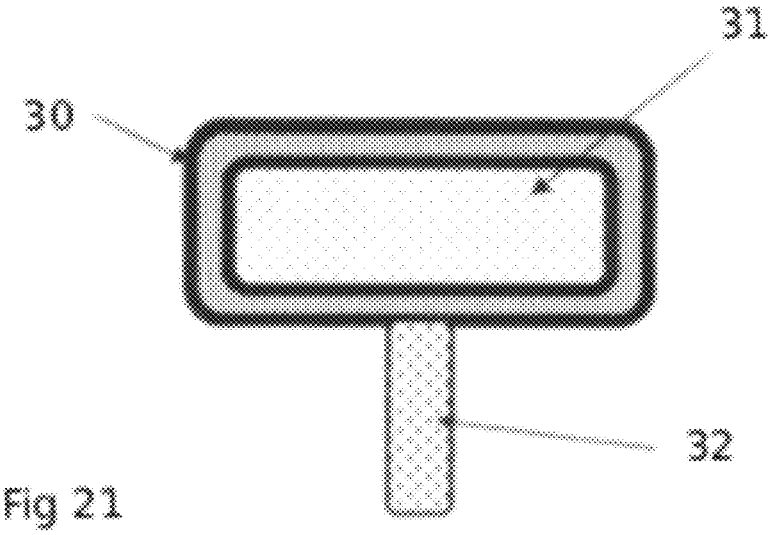
FIG. 21. Shows the top view of a durable dye pan, 30 which is a cradle/host for the insert/liner shown at FIG. 22.
Figure 22:
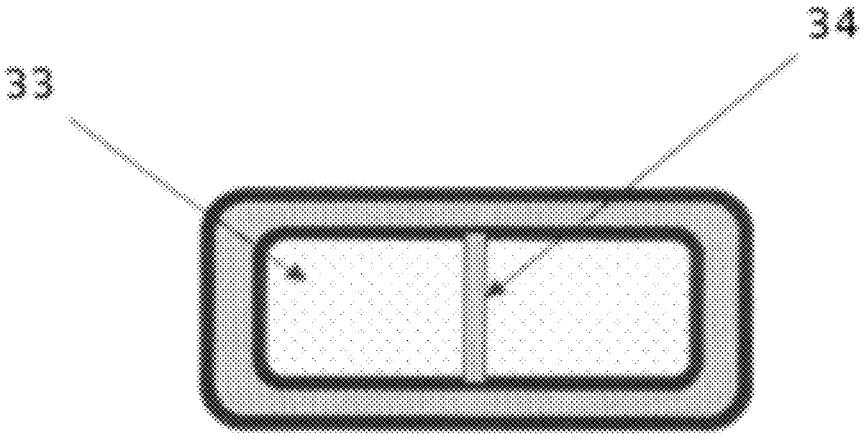
FIG. 22. Shows the top view of a disposable insert/liner designed for sitting inside of the durable dye pan shown in FIG. 21.
Figure 23:
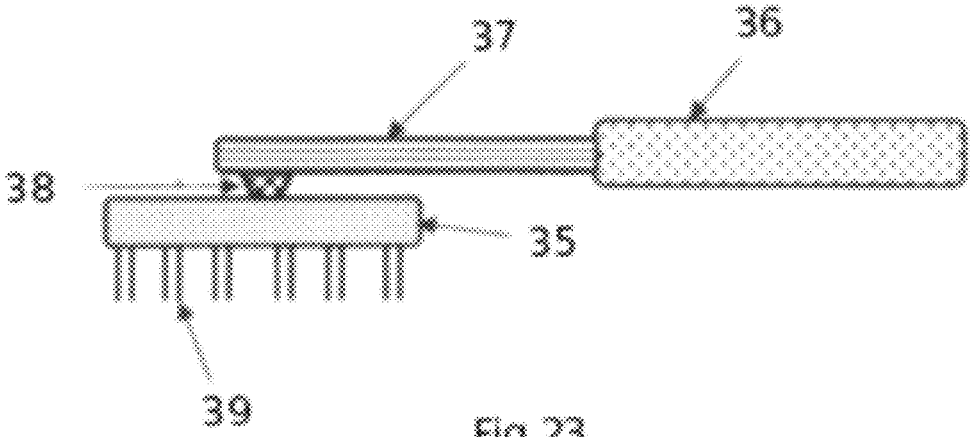
FIG. 23. Shows a unit which has a disposable brush means which matches the dye pan shown at FIG. 22.

FIG. 21 shows schematically the top view of a simpler durable dye pan, shown at 30 which functions similar to the unit shown at FIG. 4 and is a cradle which will host a liner shown at FIG. 22. So that the disposable matching liner shown at FIG. 22 can be placed inside this unit and cover inside the walls and prevent the dye from reaching this unit and its components. These two complimentary units functions as a single unit for allowing a smaller amount of dye to be used with a smaller brush means as shown in FIG. 23 for dying a limited numbers or part of hairs, such as mustache, eyebrows or small areas of the hairs in the front of the head or other areas as desired. The liner shown at FIG. 22 has a size and design which allows it to sit on top of and inside the durable pan shown at FIG. 21 and its sides will overlap the borders of the durable pan, so that the durable pan will not be contaminated with dye. Using the same concept at shown at FIGS. 4 and 5. The liner may have a removable dividing wall, 34 shown at FIG. 22 which makes two small spaces one shown at 33 by inserting the removable wall, 34. This design allows in first step the user to pour small amount of the dye in one side and the developer in the other side of the wall, 34, to the desired levels. Then to remove the dividing wall, 34 for allowing the dye to be mixed with the developer. The dividing wall may be used for mixing the dye with developer. Thus this system allows a small amount of dye to be made for use with a small matching brush as shown in FIG. 23. This brush may be made with or without having a round head. Also a thin vinyl envelope or sleeve shown at FIG. 24 may be used and pulled over the handle 36 of this unit to prevent them from its contamination FIG. 23. Shows schematically a special brush means, which has a rather flat base, 35 made from a relatively rigid material such as a polymer designed for holding a series of disposable brush units, 39 on its body similar to a commonly used hair brushes. The brush units can be like a regular hair like pieces or any one of the other kinds of brush units introduced in this application with having the capacity of holding and carrying a predicted amount of the hair dye to the hairs. Importantly, the brush units 39 of this unit will match and fit the size of the dye pan, shown in FIGS. 21 and 22. So that importantly, the amount of the dye needed will be the minimum and it will not be wasted. This brush unit has a durable handle, 36 for holding and may have a blade means, as well as shown in FIG. 1. Importantly, A detachable attachment means 38 allows the disposable base and brash units to be attached to the handle means and then to be detached for the brush means for being disposed so that a new one can be attached to the durable handle means for use. The disposable liner shown in FIG. 22 allows the used liner to be removed and disposed and a new one to be used. Thus this system has many advantages which are inherent to the units mentioned in this application such as.

1. These units make the process of small area hair coloring much easier, since they are simple to use and handle.
2. These units are economical, since a thin, small disposable liner will be very cheap and affordable. Also the head of brush will be cheap as well thus the use of these units will be cheaper than the use water, time and energy for washing similar units.
3. Also very importantly, since only the needed amount of the dye will be used, there will be Not much of extra dye to be wasted and this will save money.
4. From environmental stand point there will not be much of dye to enter the water system and end up contaminating the water system.

5. The use of this system is easy and very much controlled; the system it will reduce the droppings of dye and contamination of surrounding.
6. It makes the units clean and hygienic, since the disposable pieces will be thrown away after use thus will eliminate or significantly reduce the spread of germs and diseases.
7. In a place that units may be used in different people it will provide piece of mind to the costumers when they know that a new units is used for them alone.

Figure 24:
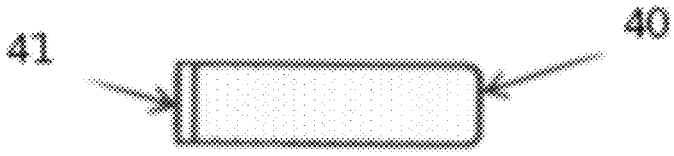

FIG. 24. shows schematically a thin vinyl envelope or a sleeve designed for being pulled over the handle of the dye pan units shown in FIGS. 2, 4, 21 or similar for preventing them from contamination in the figure the body of the envelope is shown at 40 and the opening of the envelope at 41.

Figure 7:
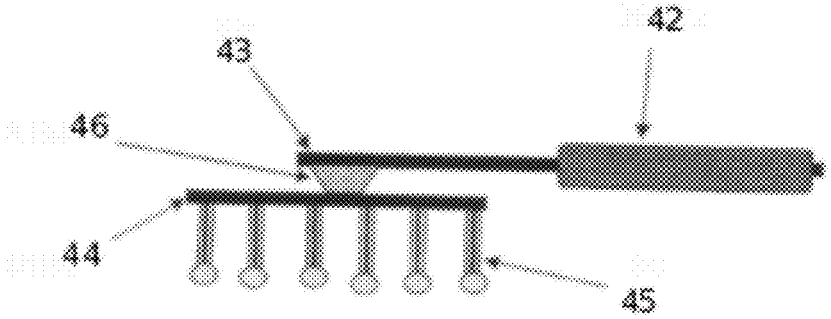
FIG. 7. Shows a brush means that has a re-useable handle and disposable brush means.

FIG. 7. Shows schematically a brush means with a durable handle and disposable brush means, so that by this method the brush means has a re-useable handle means, 42 with disposable brush means, 44, so that the handle means can be reused and the brush means can be disposed. This method has the advantage of using a durable, deluxe, handle means which is economically sound. In this model the durable handle means, 42, attaches to the body of a disposable base, 44 which holds a series of the special brush units, 45 on it. The re-useable handle means, 42 has an attachment means, 46 attached to its end, 43. The attachment means 46 allows the body of a disposable base, 44 to be separated from the handle 42 so that a new brush unit means (which is the base 44+brush units 45) to be attached for use. This method allows a lesser amount of the material to be wasted as well.

The attachment of the handle to the brush means may be made by use of various methods and means such as.

A. Snapping means which in this method the end of the handle 43 snaps to the rear surface of the brush unit means 44.

B. By use of hook and loop attachment means.

C. By use of screw system, which the end 43 of the handle means can be screwed to the base Unit 44.

Figure 25:
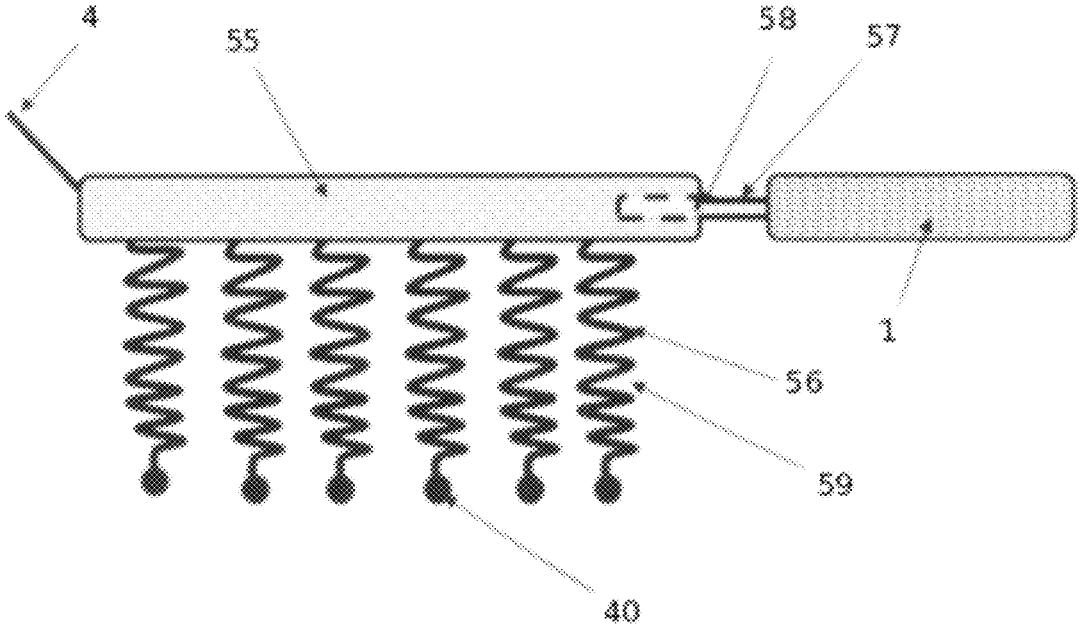
FIG. 25. Shows a brush means made with brush units with a Zig, Zag shapes.
Figure 27:
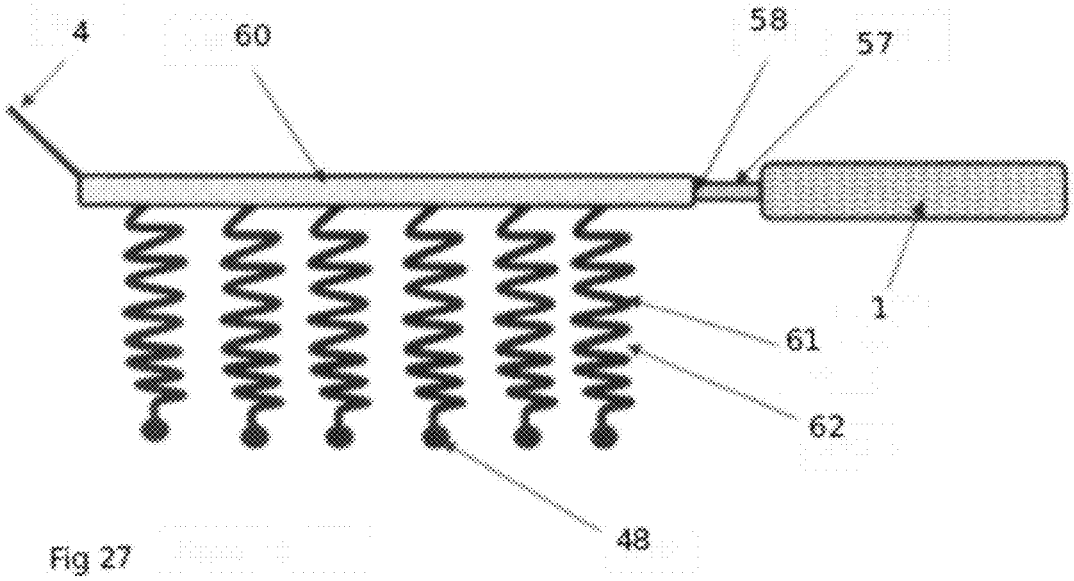
FIG. 27. Shows a brush means made with brush units with spiral shapes.

D. By having the tip of the handle 43 to fit into an opening in the body of the body of the brush means 44 as shown in FIGS. 25 and 27

E. Any other means which may be used for this purpose.

Figure 8:
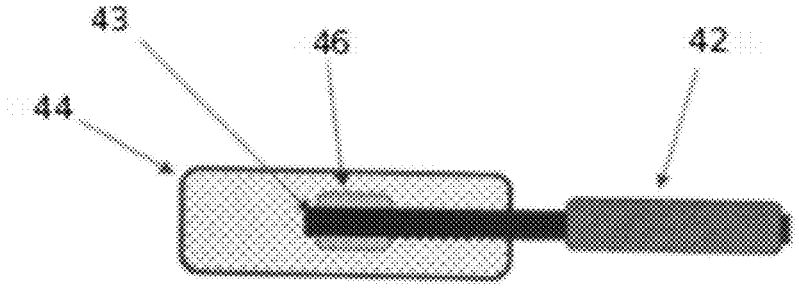
FIG. 8. Shows the top view of the brush means shown at previous FIG. 7.

FIG. 8. Shows schematically the top view of the unit shown at FIG. 7. In this figure the re-useable handle means, 42 is attached to the body of a disposable base, 44 by use of the attachment means, 46.

Figure 13:
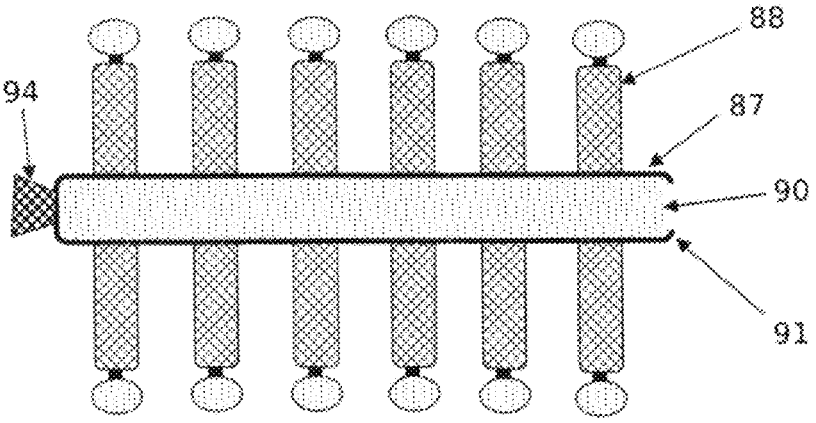
FIG. 13. Shows a disposable body of brush means, designed for use with a re-useable handle shown at FIG. 14.
Figure 14:
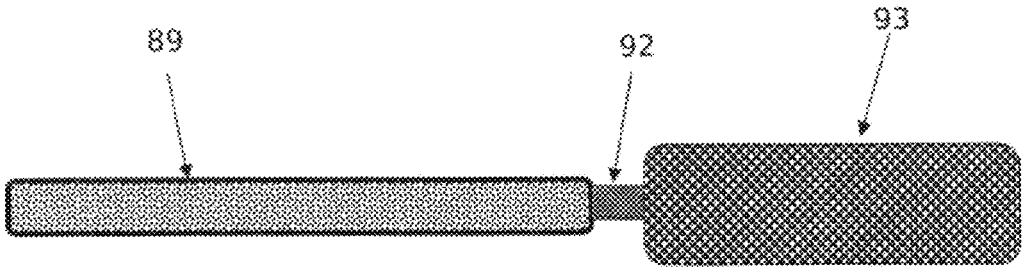
FIG. 14. Shows are-useable handle means, designed for being inserted into the body of the brush means shown at FIG. 13.
Figure 15:
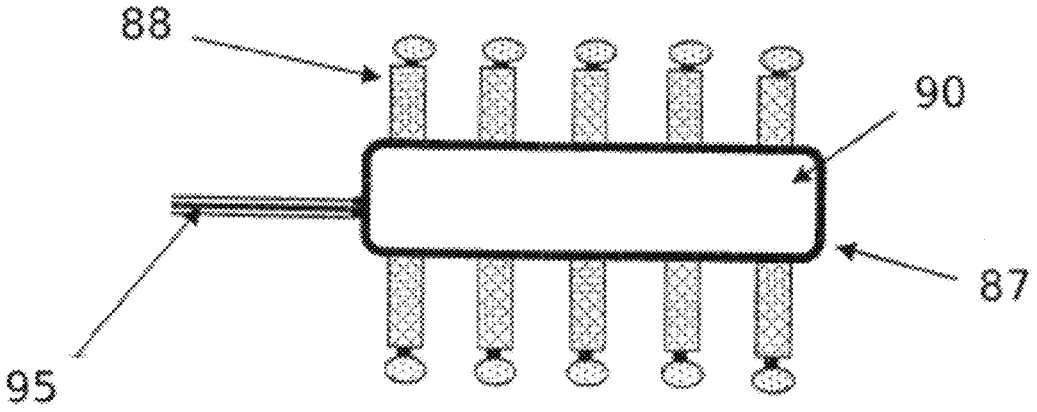
FIG. 15. Shows the cross cut side view of the disposable body of brush means, similar to one shown at FIG. 13.

In another model shown at FIGS. 13-15 the base of the unit has a double sided surface that allows the brush means to be on its upper and lower faces. This model of units may be made by having more than two faces with brush means such as three, four etc. . . .

Figure 9:
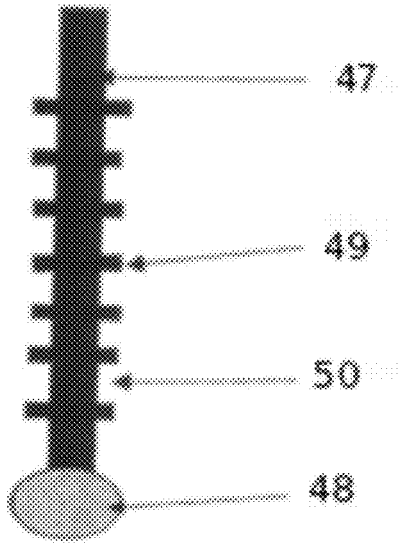
FIG. 9. Shows the side view of a brush unit with one stem with a series of walls around.

FIG. 9. Shows schematically the side view of single, special brush unit, which has a body or a vertical stem shown at, 47 with a series of short, circular walls, 49 which are located horizontally around the stem, 47 and are perpendicular to the stem. These walls are designed to be close to each other and create a space between them, 50 so that the it will hold a pre-designed amount of dye inside due to the consistency of the dye. The free end of the brush unit has a rounded head, 48 designed to prevent from the scratching of the skin. Importantly, instead of the walls the stem may be made with having other means for increasing the surface of the stem such as.

a. Short multiple side branches.

b. Spikes.

c. Indentations, bumps or buds.

d. Holes or openings.

e. Spaces.

f. Fibers attached to the stem.

g. By a series of hair like units.

Or any other means or modifications that increases the surface of the stem and modifies its surface to allow the temporary attachment of the dye to the stem and its parts and the surfaces for delivery to the intended area to happen.

Figure 10:
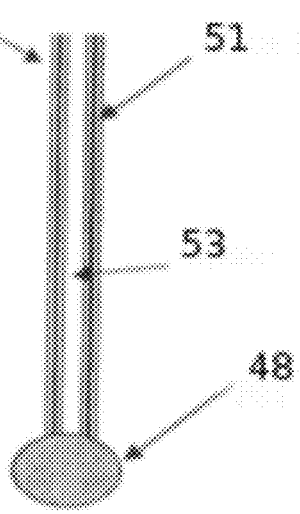

FIG. 10. Shows schematically the side view of another brush unit, which has a body consisting of combination of two separate stems, 51 and 52 with a distance between them, shown at 53. So that the surfaces of the stems and the space between them will hold a predesigned amount of dye for delivery. The end of the brush unit also has a round head, 48 so that it will not scratch the skin. Importantly the size and numbers of these stems may vary.

Figure 11:
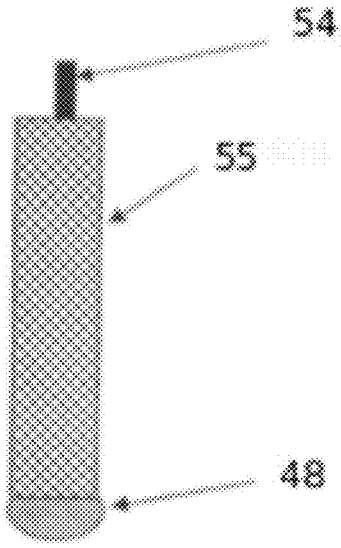
FIG. 11. Shows a brush unit with a stem covered with a layer of absorbent material.

FIG. 11. Shows schematically the side view of another brush unit, which also has a stem, 54 made from metal or a relatively hard and resilient material which is covered with a layer of absorbent material such as the cotton shown at 55. The free end of this brush unit also has a round head, 48 for preventing from the scratching of the skin. This model allows the following.

1. This unit can be immersed inside a pan of dye so that when removed it will hold a predicted amount of dye for being delivered to the hairs.
2. Importantly, when used in a dry condition it can be brushed thorough a hair group which already are covered uniformly with a hair dye, in order to absorb some of the dye on the hairs. By doing so, the absorbent material will absorb certain amount of the hair dye during its passage through the hairs. Thus it will remove the dye from certain hairs and will prevent them from being dyed on a uniform fashion; this therefore will create a differential coloring. The size, thickness, and the affinity of the absorbent material may vary and it may be made from fibers of polymers that allow the brush unit to be washed and used. Naturally, the amount of the dye removal will depend to.

a. The numbers of the times which a dry brush is moved through the hair groups.

b. The thickness of the absorbent material.

c. The nature of the absorbent material.

d. The width of the brush unit may vary so that with the rotation of the stem of the brush unit the exposure of the brush unit to the hairs can be changed.

This can be adjusted in order to allow the user to choose the amount of the dye which he/she wants to remove in the process.

Figure 33:
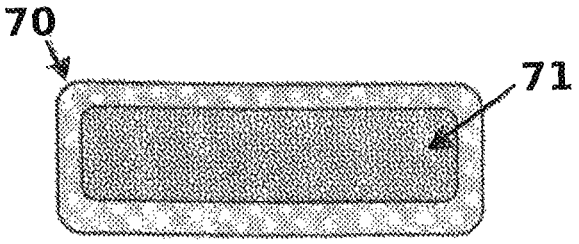
FIG. 33. Shows the base of a brush means with a rubber cushion base in the center.

FIG. 25 shows an example of brush units which in these models also the brush consists of a main body referred as base shown at 2 in FIG. 1 which is a rather flat body similar to the body of commonly used hair brushes, it may have a rubber, silicone or similar synthetic base for making the base flexible, as shown in FIG. 33. The brush base shown at 55 in FIG. 25 is designed for holding a series of special brush units; one is shown at 56 on its surface. The brush units, 56 in these units may have any design or makeup, for serving the goal of holding and carrying a predicted amount of the hair dye for dying the hair of humans and animals. It may also have any texture for being used for coloring the hair. These brush units, may also be used for removing special amount of the hair dye which a person has already has applied to the hairs. These brush units may be made from the following make ups, means and designs. They may have a body made from shaped stem. In the prototype unit the brush unit may be made from a straight stem as shown in FIG. 1, except with having a rounded end designed to prevent from scratching the scalp. However, importantly, this brush is designed for use with a special dye pan which is specified in this application with a model shown in FIG. 2. So that each brush unit or a group of brush units will enter into a particular space which is designed for holding a specific amount of the dye for being carried to the hairs. The base may be removably attached to a handle by a means of different connection means here shown at connection piece, 57 fitting a matching space 58 as shown in FIG. 25. In the prototype model the connection piece consist of the tip of the distal tip of the handle means which is designed to be inserted inside a matching space in the base, designed to accept the tip of the handle on a detachable re-attachable fashion allowing it to be used as a single sturdy unit. After the use the tip of the handle 57 can be detached from the base of the used brush means so that the used brush means can be disposed and a new brush means to be attached to the tip of the handle. This unit has a handle, 1 for holing the brush;

however, the unit may be made without the handle and the person to hold the unit with holding the base. Also the unit has a blade means, 4 in its end. The blade means is designed for wiping the dye from a surface explained in the text and to move the dye into small specially designed spaces, shown at dye pan, 7 in FIG. 2. For more details please note the model shown FIG. 25.

Importantly, the connection means between the tip of the handle and the base of the brush means may be done by various means such as.

1. Screw means, so that the tip of the handle means can be screwed into the matching opening of the base of the brush means.
2. Snapping means so that the tip of the handle means can be snapped into the matching opening of the base of the brush means.
3. Or any other possible attachment means which may be used for this purpose.

Figure 29:
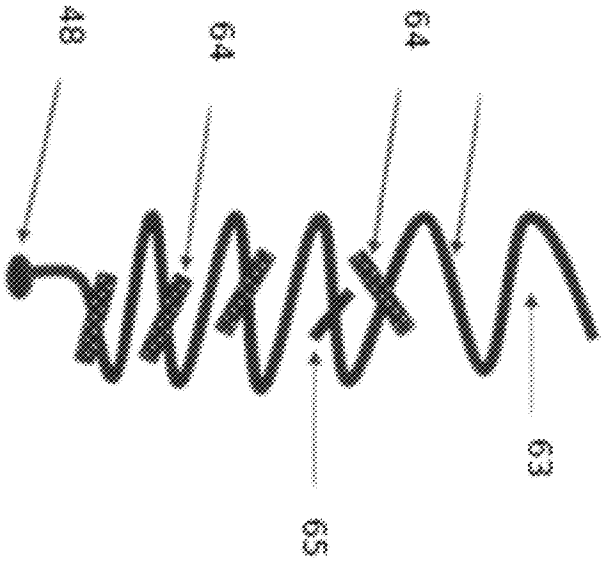
FIG. 29. Shows a Zig, Zag brush unit, with side branches.
Figure 32:
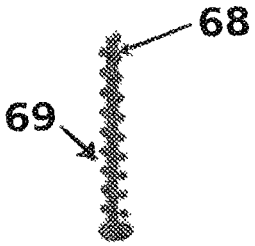
FIG. 32. Shows a brush unit with a stem and series of buds on its body.

FIG. 25. Shows a brush is made from series of brush units, 56 which are made from a stem with a Zig, Zag shape, creating an angular space in between its two adjacent pieces shown at 59. This design allows a calculated amount of hair dye to attach to the body of stem and the spaces between its bodies due to the viscosity of the hair dye, for being carried to the hair. Importantly, the brush unit may also have extra branches as shown in FIG. 29 and or may also have bumps/buds in the body of the stem as shown in FIG. 32. This unit also has a handle for holing and also has a blade means, 4 in its end. The blade means is designed for wiping the dye from a surface explained in the text and is designed to move the die into small specially designed spaces, shown at dye pan, 7 in FIG. 2. The brush unit has a rounded head shown at 40.

Figure 26:
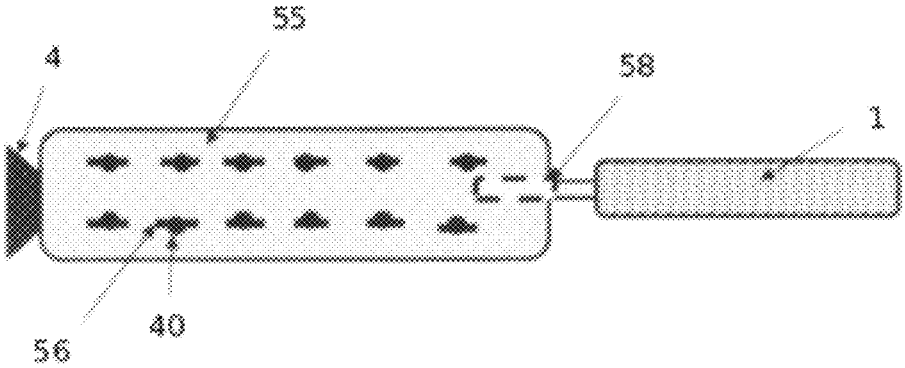
FIG. 26. Shows the side view of the brush unit shown in FIG. 25.

FIG. 26 shows schematically the side view of the unit shown on previous FIG. 25. In this view the
brush unit is viewed in an axis parallel to the body of the brush unit. Thus the body of the brush unit,
56 is viewed as a short straight line and its round tip will be viewed as a small circle shown at 40. The base of this unit is shown at 55; the handle is shown at 1 and the connection point in 58. FIG. 27 Shows a brush means which is very similar to the unit shown at FIGS. 25 and 26 except it is made from a series of brush units which are made from a stem with a spiral shape body 61, creating spaces 62 between its adjacent bodies, please also note the side view of this model in FIG. 28 This design also allows a calculated amount of hair dye to attach to the stem and the spaces between its adjacent bodies due to the viscosity of the hair dye, and the size of the distance between the two adjacent bodies of stem. This unit also has a handle, 1 for holing and also has a blade means, 4 in its end. The blade means is designed for wiping the dye from a surface explained in the text and is designed to move the die into small specially designed spaces, shown at dye pan, 7 in FIG. 2.

Figure 28:
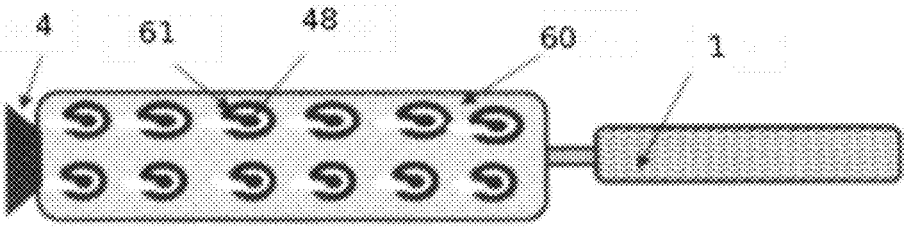
FIG. 28. Shows the side view of the brush means shown in FIG. 27

FIG. 28 shows schematically the side view of the unit shown on previous FIG. 27 In this view when the brush unit is viewed from its head to its base, the body of the brush unit will be viewed
almost as a circle shown at 61 while its round tip will be viewed as a small circle shown at 48. The base of this unit is shown at 60; the handle is shown at 1.

Please note that the connection means between the tip of the handle and the body of the brush means is not shown here but it is the same as previous figure.

FIG. 29. Shows schematically a single brush unit with a stem which has a zig, zag shape, similar to the unit shown at FIG. 25 and has a series of angular space in between its two adjacent
bodies, which one of them is shown at 63. This unit is further modified by having a series of branches such as one shown at 64 and the 65. These branches are designed to increase the dye carrying capacity of the brush unit, since the surface and the numbers of angles of the unit will
increase. Importantly, the makeup of these branches may wary. For example the A. Branch, 64 may be covered or made from an absorbent material such as cotton. With a higher degree of carrying or absorption capacity.
B. The Branch, 65 has a body similar to the body of the stem except it functions to increase the overall surface of the unit and numbers of the angles.

Figure 30:
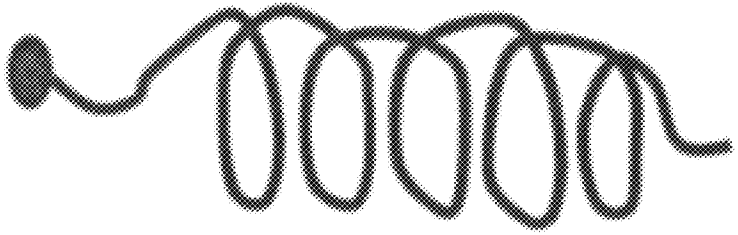
FIG. 30. Shows a spiral brush unit.

FIG. 30. Shows schematically a brush unit similar to one shown in FIG. 27, with slightly different body in order to show a brush unit which has a body made of a spiral stem. The body of stem may have further small branches for holding more dye as shown in 64 and 65 in FIG. 29.

Importantly, please note that the size, thickness, surface texture, the proximity or distances of the pieces of the body of these brush units and all other important characteristics of these brush units may vary.

Figure 31:
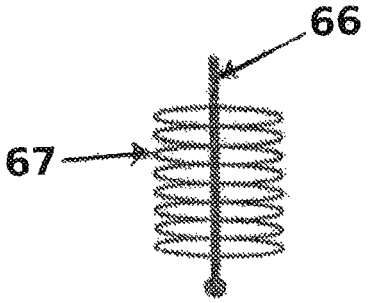
FIG. 31. Shows a brush unit with a stem and fibers attached to the stem.

FIG. 31. Shows schematically a brush unit which has a body made of a stem, 66 with a series of fibers 67 attached to its body in different directions. The presence of these fibers will create multiple surfaces, areas and spaces around the stem which will make it able to attract or allow them to attach removably the small amounts of the dye. So that;

A. The dye attaches to the body of the stem and fibers.
B. The proximity of these fibers may allow an amount of the dye to attach to the stem and
different fibers. This unit may be used for not only the application of the dye but also for the removal of the dye previously applied to the hairs as well.

Importantly, please note that the size, thickness, surface texture, the proximity or the distances of the fibers and all other important characteristics of these brush units may vary.

FIG. 32. Shows schematically a brush unit which has a main body 68 made from a polymer with a series of bumps or buds, 69 or extrusions on its surface. These buds are designed to increase the surface areas of the stem to make it able to attract more amount of the dye for being carried.

Importantly, this unit and all other units explained in this text may be also used for not only the
application of the dye but also for the removal of some of the applied dye On the hairs as well. Importantly, please note that the size, thickness, surface texture, the proximity or the distances of the fibers and all other important characteristics of these brush units may vary.

FIG. 33. Shows schematically only the base of a brush means without showing the brush units. This piece has a main body referred as base 70, which is a rather flat body similar to the body of commonly used hair brushes, except this unit has a center part, 71 made from a flexible material such as rubber, silicone or similar which will make a flexible base for the brush units and will acts as a cushion base for the brush units which will be attached to it. mmm FIG. 12. Shows schematically a tray means which is made to create combinations of two independent dye pans 85 and 86 for delivering two different dyes. This unit makes two relatively identical delivery system which are divided by a wall, 71. Each one of these units is similar to the dye delivery system shown at FIG. 2. Thus this unit has the following parts.

a. a series of cylindrical empty spaces, 73 and 74 designed to allow one brush unit, of the brush means similar to the unit shown at FIGS. 1, 3, 7, 25, 27, 13 to be inserted inside these cylindrical spaces and be immersed in the dye poured in these spaces. So that when the brush means is removed from the cylindrical spaces each brush unit will be covered with a special, predesigned amount of the hair dye. Thus the numbers of the cylindrical spaces, 73 and 74 will match the numbers of the brush units, from the brush means.

b. A first floors, such as 75 and 76 which are flat/horizontal surfaces which the cylindrical spaces 73 and 74 are attached to them and at the time of use these floors will be in a horizontal position.

c. One side of each first floor has a pan for holding the dye, shown at 77 and 78, which function as a small pan and allows two different hair dyes to be emptied inside each one of these small pans.

d. A higher floor or a second floor shown at 81 and 82 which are flat surfaces which stand one level higher than the floor 75 and floor 76 and have their own surrounding walls; 83 and 84 which they will prevent from the dyes from leaving this pan means, similar to the unit shown at FIG. 2. Note at the time of use the second floors also will be in horizontal position.

e. Also there are ramps such as 79 and 80 for allowing the dyes to be swiped into the small clylindercal spaces, 73 and 74. The advantage of this unit is that it allows two different colors of hair dye to be placed in each separate side of this unit and to be utilized with.

At the time of use.

1. A brush that will be used once with first dye in 73 and then by use of the second dye in 74.

2. Or with a brush that has enough numbers of the brush units, which will allow half of the brush units to be used with the first dye in 73 and the other half with the second dye in 74.

3. The brushes may have two blades for being placed in the sides in order to allow the wiping of the dye to be done easily in each side of this pan. A first floors, such as 75 and 76 are flat surfaces that the cylindrical spaces 73 and 74 are attached to them and at the time of use these floors will be in a horizontal positions. The ramps and the other parts will mimic the unit shown at FIG. 2. The use of two dyes with different colors will allow two colors and shades of these two colors to be applied to the hairs and create differential coloring. Importantly, more than two colors may be used with utilizing this method and the main teachings, such as having three or more sets of pans, floors or ramps etc. Also importantly, the size of these two areas may not be similar and they may vary in order to accept different numbers of the brushes for each side to be used. xxx.

FIG. 13. Show schematically a disposable body of brush means that is designed for use with a re-useable handle means shown at FIG. 14. In this model the body of the brush means, 87 is made of a hollow unit with five sides, one up, one down, one in each sides and one in front. Such as a rectangular cuboid with five sides made from a relatively rigid means that holds a series of brush units, 88 on its upper and lower surfaces. This unit allows a re-useable handle means, shown at FIG. 14 to be inserted inside the hollow center part of this unit in order to be functional. This re-useable handle means shown at FIG. 14 has an insert part, 89 which matches the size and shape of the hollow center part of the unit shown at FIG. 13 and will fit inside the inner hollow space of that unit to make a functional unit. The tip of the insert part, 89 will be pushed into the opening, 90 of the unit shown at FIG. 13. The front sides of the body of the brush means, 87 are modified to function as a clip means, 91 designed to engage with the zone between the neck, 92 and the body of the insert, 89, from the handle means shown at FIG. 14. This engagement will keep the disposable piece in place during the use until the user decides to remove the disposable piece by holding the handle 93 from one hand and pulling the body of the brush 87 by use of holding the end piece 94 designed for this purpose. The piece 94 may be modified to function as blade as well. This is one of the methods presented in this application which allows the user to use a disposable brush means for the delivery and removal of the dye on the hair. Importantly, note one group of the brush means shown in first side here may be used for the delivery of the dye and the second group other brush means from the second side of this brush means may be used for the removal of the dye if so desired. Importantly, the unit may have four sides covered with the brush means. Also importantly, the makeup of the brush means in first surface of this unit may be different than the brush means on the second surface for example referring to the FIGS. 9-11 one series of the brush units shown in FIG. 9 to be on the upper surface of the unit shown in FIG. 13 and another series of the units shown at FIG. 11 on the lower surface to allow first series to be used one time and the second series to be used afterward. Also it can be the same as other brush units shown in other figures such as 25, 26, 27, 28, 29, 30, 31, 32 and 33. So that the user can use one surface for one reason and the other surface for other reason whatever the uses may be. For example the side with brush unit with FIG. 9 for application of the hair dye and side with brush unit with FIG. 11 for the removal of the hair dye applied on the hair. FIG. 14. Shows schematically the side view of the body of a handle means, which consist of an insert piece, 89 designed to match the inner shape and size of the body of the hollow inner space of the body of the brush means shown at FIG. 13 so that this unit can be inserted inside the hollow center of that unit. The insert, 89 is connected to a neck piece, 92 which the front end of the neck 92 will engage with the 91 of the unit shown at FIG. 13 in order to keep these two units attached and in place. The other end of the neck piece, 92 is attached to the handle means, 93. So that with the insertion of the insert inside the body of brush the combination will make a complete brush unit with a reusable insert and a disposable brush means and to be functional. After the use the insert will be removed from the body of the Brush and it will be ready for use with a new body of the brush unit and the used body of the brush will be disposed. FIG. 15. Shows schematically the cross cut side view of the body of the disposable brush means, 90 similar to one shown in FIG. 13 In a vertical short axis of this unit which is ninety degree from the plane shown in FIG. 13. In this figure the body of the brush means, 87 is shown with its hollow space 90 designed for accepting the insert, 89 of the handle means, 93 shown at FIGS. 14 and 16. So that it will be inserted inside the hollow space for making a complete unit for use. The brush units, 88 are attached to the outer surfaces of this unit and a blade 95 is attached to its side.

Figure 16:
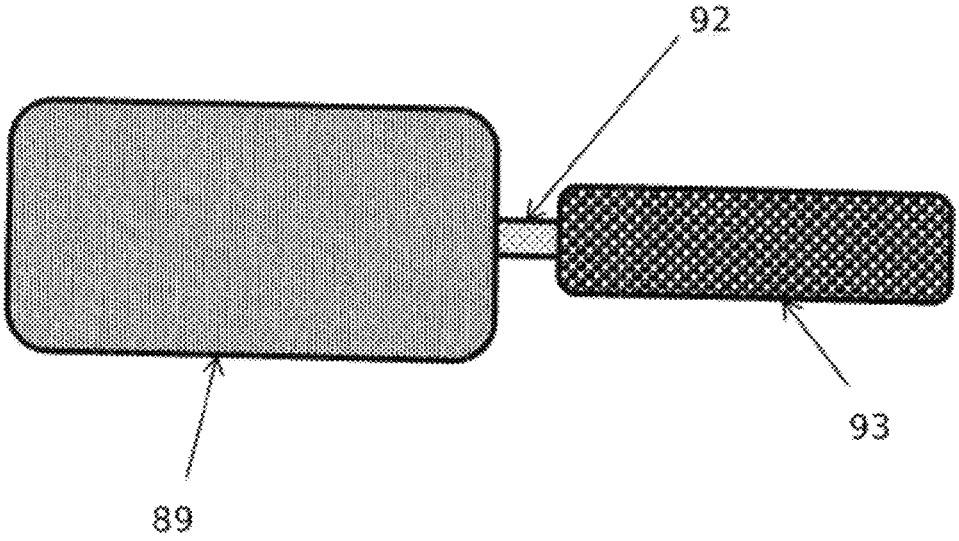
FIG. 16. Shows the top view of the re-useable handle means, shown at FIG. 14.

FIG. 16. Shows schematically the top view of a re-useable handle means, shown at FIG. 14. In this figure, the insert part is shown at, 89 the handle part is shown at, 93 and the neck, 92 between them. This unit is designed to be used with units such as one shown in FIGS. 13, and 15.

Figure 17:
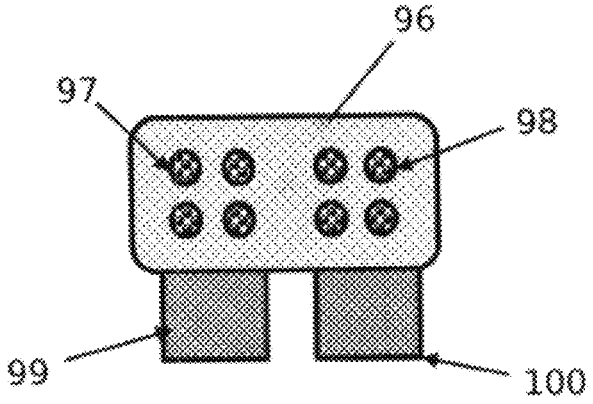
FIG. 17. Shows schematically a modified, disposable brush means for use with the dye pan shown at FIG. 12.

FIG. 17. Shows schematically a modified, disposable brush means for use with the dye pan shown at FIG. 12. In this model the body of the brush means also has a hollow body similar to the unit shown at FIGS. 13 and 15. And uses a matching handle means similar to the unit shown at FIGS. 14 and 16 for making it functional. The body of this unit is shown at, 96 which is made of a hollow box shaped body, like the outer part of a match box, and is made from a relatively rigid means which holds a series of brush units, 97 and brush units, 98 on its surface. Per design, when used with pan shown at FIG. 12. The brush units, 97 is capable of carrying different dye than the 98. This unit may also have two blade means, 99 and 100, for use with the dye-pan 77 and dye-pan 78 from the unit shown at FIG. 12.

Figure 18:
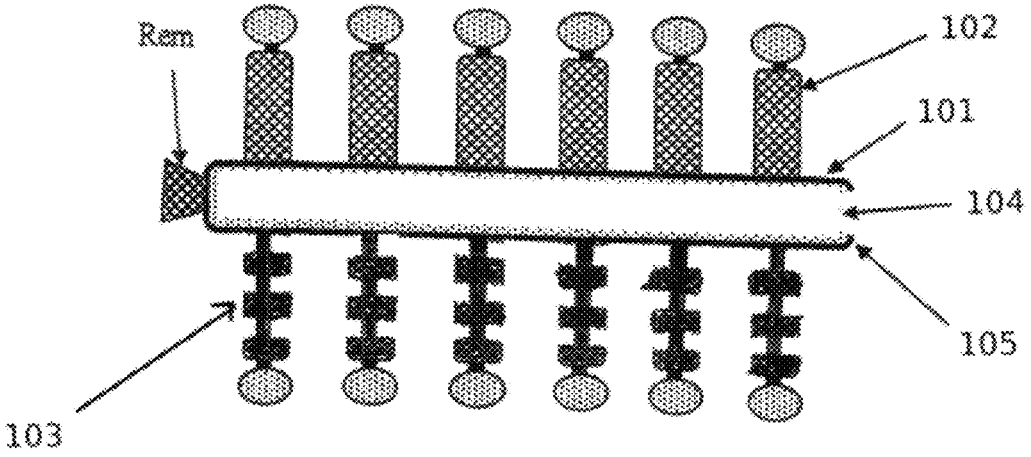
FIG. 18. Shows a disposable brush means similar to the model shown at FIG. 13 except it has two different brush units.

FIG. 18. Shows schematically a longitudinal cross cut view of a disposable brush means, similar to the model shown at FIG. 13. This unit has a hollow body with four side walls and one in front which will accept and accommodate the insert means shown at FIGS. 14 and 16. The upper and the lower walls have a rectangular shape with about 2.75 inches wide by 4.5 inches long. With two side walls of 0.5 inches by 4.5 inches and the front wall of 0.5 by 2.5 inches. Except this unit also has two different brush units, 102 and 103 which are different, for example the upper surface of this brush means unit 101 has the brush units 102 similar to the units shown at FIG. 11 but the lower surface has brush units 103 which are similar to the units shown at FIG. 9. So that there will be option of using different brush units with one brush means. In this figure the body of the brush means, 101 is shown with its hollow opening for the insert, 104 which will accept and hold the insert, 89 of the handle means, shown at FIGS. 14 and 16 for making a useable unit. The clip means is shown at 105. Thus importantly, the brush means may have one model of the brush units chosen from one of the models shown in this application as shown in FIGS., 9, 10, 11, 25, 26, 27, 28, 29, 30, 31, 32 and 33 or any other kind on its first surface and one other model of brush units as shown in those figures on its second surface. Also importantly, the brush means may have more than two surfaces such as three or four or more with different brush units on its different surfaces for more options.

Importantly, the base of the brush units explained in this text may have a rubber cushion base as shown at FIG. 33 when applicable to make the units more friendly and comfortable. Importantly, the size, shapes, the relative sizes, the materials of all the units shown in these figures may vary in order to made special units.

DETAILED EXPLANATION OF THIS INVENTION

The hair coloring is common for beautification, religious beliefs and expression of choices. At present commonly, a single hair dye is applied universally to the hairs which will leave a uniform coloring of the hairs. However, this may not be ideal in certain conditions, for example when the person wishes to have shades of hair coloring also in cases which a person wishes to have a more artistic hair coloring than a uniform hair color and in cases which the user wishes to have mixture of different colors or more in his or her hairs. For these reasons this application presents methods and means which allows a differential coloring of groups of hair to be possible. In this application the applicant introduces a hand hold brush means that allows a predicted amount of hair dye to be carried to the hairs for application. This is by use of a brush means that have a series of brush units which are capable of holding a predicted amount of the hair dye for being taken for being delivered to the hairs. This method has the advantages that first, it allows the application of the dye to the hair to be easy, and second, it allows some groups of the hairs to be spared from being dyed. Third, it also allows some of the hair dye which was already applied to the hairs to be removed, thus finally the hairs will have different groups, some which has received full dose of the hair dye and others with much lesser hair dye and a third group which has different shades of the hair dye on them. Thus at the end this method allows the hairs to have shades of the hair dye on them and to look different than having a universal coloring. This application also allows two or more hair dyes to be applied at one time for creation of different over all hair coloring. For understanding this method and means the applicant invites reviewing the Figs. FIG. 1. Shows schematically a special brush means, (SBM) which consists of a base, 2 which is similar to the body of a commonly used hair brush and is designed for holding a series of special brush units, 3 on its surface. The brush units, 3 are designed for holding and carrying a predicted amount of a hair dye and are shown in more details in FIGS. 9-11. This brush unit has a handle, 1 similar to the handle of commonly used hair brushes for holing in the hand. Also it has an optional blade means, 4 in its end which is designed for mixing and wiping of a hair dye after the hair dye is poured inside a special space referred as the dye pan, 7 shown in FIG. 2. The purpose of this brush means is to allow its brush units, 3 to be dipped in a pan which has hair dye and to carry a predicted amount of the hair dye for application on the hairs.

FIG. 2. Shows schematically a special tray means designed for holding and mixing of a hair dye for being used by the brush means shown at FIG. 1. This unit consists of the following parts.

a. a series of cylindrical shaped empty spaces, 5 designed for holding a special amount of hair dye and allowing only one brush unit, 3 of the brush means shown at FIG. 1 to be inserted into only of these cylindrical spaces 5 for being immersed inside the dye when the dye has been poured into these spaces. So that each brush unit, 3 will enter into a matching single cylindrical space, 5 which is filled with dye. Thus when the brush means is removed from the pain means shown at FIG. 2 each brush unit, 3 will be covered with a predesigned amount of the hair dye, some may have more and some may have less or each one may have equal amount of dye as the user wish. Thus, the numbers of the cylindrical spaces, 5 and their locations will match the numbers and the locations of the brush units, 3 from the brush means shown at FIG. 1.

b. A first floor, 6 which is a flat layer with a flat surface, designed for holding the cylindrical spaces, 5 and the upper border or the edge of the cylindrical spaces is in the same level as the floor, 6. So that the hair dye can be moved to the surface of the flat layer and be moved to fill the cylindrical spaces.

c. The front part of the first floor, 6 has a relatively small pan 7 designed for allowing a hair dye to be poured inside this small space for being prepared and used. This small pan 7 has a front and a rear ramps, ramp1, 8 and ramp1 9. The ramp, 8 is essential and is located between the rear border of the dye pan, 7 and the front border of the first floor, 6. The ramp1 9, is located between the front border of the dye pan, 7 and the first floor, 6 as shown these ramps allows the blade, 4 of the brush unit shown at FIG. 1 to pull or wipe the dye from the dye pan, 7 to the surface of the flat surface, 6 and pulling the dye farther for filling the cylindrical spaces, 5. Please note the ramp 9 is not essential and may not exist in all such units.

d. A second, flat floor, 11 is designed to stand one level above the first floor, 6 and it has a surrounding wall or a side wall, 10.

e. The surrounding wall, or side wall, 10 is a vertically located wall which is attached vertically to the edge or the border of the second floor, 11, so that it will prevent the dye from being spilled out of the surface of the second floor, 11, this wall is also shown at FIG. 4. Importantly, the sizes and relative sizes and the thickness of these parts may vary for making a particular model.

f. A handle means, 12 is designed for allowing this unit to be hold by a hand comfortably, this handle is attached to one of the side walls, 10 or the bottom floor of this unit or to any desired location of this unit so that it allows the unit to be held by hand in a comfortable and steady position. Commonly by the right hand in right handed persons and the brush means to be hold by the left hand. Commonly the handle of the pan 12 will be in right angle compared to the handle 1 of the brush means.

Importantly, please note that although the use of only one brush unit, 3 of the brush means shown at FIG. 1 is emphasized for being inserted inside only one of these cylindrical spaces however, one may choose to have two or more brush units adjacent to each other in order for being immersed inside the one larger cylindrical space, 5 in order for being covered with the dye. Thus in practice those two of three brush units will in fact function as a single unit for this purpose. Importantly, the brush unit shown at FIG. 10 has two stems going to one cylindrical space, 5 except it has one round head, 48, however, it is easy to consider that each one stem may have its own round head as well or the brush unit to have three or more stems which will inter into one cylindrical space, 5.

FIG. 3. Shows schematically a brush means similar to the unit shown at FIG. 1 which is designed to match and be used with the dye delivery tray means, shown at FIG. 4. So that at the time of use each brush unit, 3 of this brush means will dip into one of the matching small cylinderal space 5, of the pan in order to receive special amount of the hair dye.

FIG. 4. Shows schematically the side view of the dye delivery tray means similar to the model shown at FIG. 2. This figure shows the two pans, Pan1 shown at 13 and pan2 shown at 14 which are made by having a vertical wall means around the horizontal first and second floors means, 6 and 11 respectively. So that the vertical walls will prevent the dye inside them from spilling out of these pans. The upper level or the edge/rim of the cylindrical spaces, 5 are attached to the flat surface 6 of the first floor. In this model as mentioned each cylindrical space allows one brush unit, 3 of the brush means shown at FIG. 3 to be inserted inside these cylindrical spaces in order to be immersed in the dye which will be poured inside these spaces. The second pan means, Pan2 shown at 14 stands above the first pan means, shown at 13 and has its own vertical wall, referred as 10.

The handle means, 12 of the pan means is attached to the side of the Pan2 shown at 14. The front part of the first floor 6 has the dye pan, 7 with the adjacent ramps, allowing the blade, 4 from the brush unit shown in FIG. 3 to swipe the dye from the dye pan up to the surface of the first floor 6 for filling the cylindrical spaces, 5. Importantly, the unit shown in FIG. 4 will be made from a relatively rigid and durable body such as metal or synthetic hard material, so that will be strong and sturdy. Importantly, even though this unit may be used alone however, preferably it will be designed for being used as a cradle for placement of a disposable matching insert shown at FIG. 5. The base, 15 is a body which has the series of the small cylindrical spaces shown at 5 and the side walls of the small cylindrical spaces, 5 attaches to the first or the lover floor shown at 6. The opening 18 allows the pans to be accessed or the insert shown at FIG. 5 to be seated inside this durable unit.

FIG. 5. Shows schematically a disposable insert, made from a thin polymer which has a body, a size and the engineering make up which matches and fits inside the durable cradle unit shown at FIG. 4. Thus the shape of the outer or the lower surface of this insert will be almost exactly matching unit similar to the shape of the inner/upper surface of the durable unit shown in FIG. 4, except it will be a shade smaller so that it will allow the placement of the insert inside or on top of the cradle shown at FIG. 4 to occur. Thus due to its all over thin body the shape of the inner surface of the cradle will be approximately the same as it's outside minus its thickness. This insert has an edge, shown at 24 which will overlap the outer side wall, 10 of the body of durable unit shown at FIG. 4 so that the edge 24 will sit and cover the side wall 10 for the purpose of preventing from the contamination of the edge of the durable unit with the dye. This disposable insert will function as follows.

1. It makes the use of these units easier and will save time and money, since the user does not need to use water for washing the cradle unit shown at FIG. 4.
2. It makes these units economical, since a thin disposable liner piece will be cheap and affordable.
3. It will make the units clean and hygienic, since this thin disposable liner will be disposed after use thus will eliminate or significantly decrease the spread of germs and diseases.
4. In a place that units may be used in different people, such as hair salons it will provide piece of mind for the costumers when they know that a new unit is used for them alone.

These inserts=liners simply matches the inside surface of the hard unit shown at FIG. 4 and will simply fit inside. A unit for covering the handle called handle cover, shown at 16 will go over the handle and has a door means hinged to it at 17, so that it will cover the lower surface of the handle and snap to its own wall so that even the handle part will be covered as well. Each part of this insert unit has a matching piece that will fit the parts of the unit shown at FIG. 4. Importantly, it is possible for the durable unit/cradle shown at FIG. 4 to have a common open space for the cylindrical spaces, shown at 5 to sit or to have only shallow spaces to allow only the lower ends of the cylindrical spaces 5 to sit inside and be secure without jiggling and moving. The outer wall of this insert unit shown at FIG. 5 will overlap the side wall, 10 of the Pan 2 shown at 14 from the unit shown at FIG. 4.

FIG. 6. shows schematically the top view of a simpler dye pan, which is a pan with dividing walls, 26 making a series of small spaces which will accept a matching brush unit. This figure is to illustrate that other sorts of dye pans may be made for use. Although the model shown at FIG. 2 has the advantage which with use the cylindrical spaces, 5 the dye can be used with the smallest amount needed.

FIG. 19. shows schematically the cross cut view of the dye pan means, 26 shown in previous FIG. 6. In this view the small spaces are shown made by use of walls, 26.

FIG. 20. shows schematically a dye pan means, 25 which is similar to unit shown in previous FIG. 6. except in this model the body of dye pan is divided to two sharing pans as shown so that one group of brush units will fit into one side of this pan, shown at 28 and the other group will fit inside the other side of the pan, shown at 29.

FIG. 21 shows schematically the top view of a simpler durable dye pan, shown at 30 which functions similar to the unit shown at FIG. 4 and is a cradle which will host a disposable liner shown at FIG. 22. These two complimentary units functions for allowing a smaller amount of dye to be used with a smaller brush means as shown in FIG. 23 for dying limited numbers or part of hairs, such as mustache, eyebrows or small areas of the hairs in the forehead or other areas as desired. The liner shown at FIG. 22 is a disposable unit and has a size and design which allows it to sit inside the durable pan shown at FIG. 21 and the sides of the insert/liner shown at FIG. 22 will overlap the borders of the durable pan, so that the durable pan will not be contaminated with dye when the dye is poured inside the liner. Using the same concept at shown at FIGS. 4 and 5. The dispose able liner/insert may have removable dividing wall, 34 shown at FIG. 22 which will make two small spaces one shown at 33 by inserting the removable wall, 34. This design allows in first step the user to pour small amount of the dye in one side and the developer in the other side of the wall, 34, to the desired levels. Then to remove the dividing wall, 34 for allowing the dye to be mixed with the developer. Note at present commonly the hair dyes comes in two separate packages of dye and developer which needs to be mixed in certain proportion. The dividing wall may be used as a tool for mixing the dye with the developer. Thus this system allows a small amount of dye to be made for use with a small matching brush as shown in FIG. 23. The brush may be made with or without having a round head. Also a thin vinyl envelope or sleeve shown at FIG. 24 may be used and pulled over the handle of this unit to prevent them from its contamination FIG. 23 shows schematically the side view of a brush means designed for use with the pan means shown in FIGS. 21 and 22. This unit has a re-useable handle means 36 for use with a disposable brush means, 35. The body of this brush means is shown at 35 and is designed to hold a series of brush units, 39 which are similar to a regular brushes and may not have the round tips. These are mainly designed for use in small areas such as mustaches or small areas of the hairs and similar. The re-useable handle means, 36 has piece here shown at 37 which is made from a piece such as a rod similar to the piece shown at FIGS. 7 and 8 and has an attachment means, 38 close to its front end. So that it allows the body or the base, 35 of a matching disposable brush means, to be attached to this piece for being used as a brush means and then to be separated from the re-useable handle means for disposal so that a fresh brush means unit can be attached to the handle for use. The brush units are shown at 39 and importantly they have a size and structure and pattern which allow them to fit inside the dye pan means as shown in previous FIGS. 21 and 22. This design does not allow the base piece 35 to reach the dye in the pan and be contaminated with the dye. This method also shares the following advantages. yyy 1. It makes the use of these units easier, so that the user does not need to waste time, energy and water for washing the brush means.
2. It makes these units economical, since disposable pieces will be cheap and affordable.
3. This makes these units clean and hygienic, since the disposable piece will be thrown away with germs and contaminations after use and this will eliminate the chance of spread of germs and infectious diseases.
4. This method provides piece of mind to users in public places such as the hair saloons when the costumers know that a new unit is being used for them alone.
5. This method allows lesser amount of the material such as the dyes and fixers to be wasted as well.

The attachment of the handle to the brush means may happen with use of various means and methods such as.

A. Snapping means. That the handle snaps to the rear surface of the brush means.
B. By use of hook and loop attachment means.
C. By use of screws, that the handle can be screwed to the body of brush means and then unscrewed after use.
D. By having the tip of the handle to fit into a matching opening in the body of the brush means. As shown in FIG. 25. In this method the tip of the handle means 57 will be pushed into the matching opening to fit and stay stable and function and then will be pulled out after use.
E. Many other methods may be used for attaching these two pieces to each other and many more may be made by engineering. Therefore any other means which may be used for this purpose may be used in these units.

One model of a simpler disposable dye pan/liner/insert, for being used with the durable pan is shown in FIG. 22. This disposable liner matches and fits on the top and inside of the durable unit shown in FIG. 21. Please note in practice the sizes of these two units will match to allow such removable placement to happen. Also shown in FIG. 22 is the use of optional dividing wall, 34. This allows the creation of a pan with two spaces to happen. The divided pan allows a series of brush units to be inserted inside each side for receiving two different dyes.

FIG. 7. Shows schematically a brush means that has a re-useable handle means for use with a disposable brush means. The body of this brush means, 44 holds a series of brush units, 45 which are capable of carrying a predictable amount of dye as explained in the text. The re-useable handle means, Handle has a piece in its front with an end piece, 44 designed with having an attachment means, 46 at its end. The attachment means, 46 is capable of engaging with a matching part on the rear surface of the body of the brush means, 44. So that the body of the disposable brush means, 44 can be separated from the re-useable handle means after use for disposal and to allow a the body of a fresh disposable brush means, 44 unit to be attached to the handle for use. Note this figure shows the rounded end pieces of the brush units, however, they are not marked. Thus this method allows following advantages.

1. It makes the use of these units easier, so that the user does not need to waste time, energy and water for washing the brush means.
2. It makes these units economical, since a disposable piece will be cheap and affordable.
3. This makes these units clean and hygienic, since the disposable piece will be thrown away after use and eliminates the chance of spread of germs and diseases.
4. This method provides piece of mind to users in public places such as the hair saloons when they know that a new unit is being used for them alone.
5. This method allows lesser amount of the material to be wasted.

The detachable re-attachable attachment means of the handle to the brush means may be done by use of various available methods and means such as.

A. Snapping means. That the handle snaps to the rear surface of the brush means.
B. By use of hook and loop attachment means.
C. By use of screws.
D. By having the tip of the handle to fit into an opening in the body of the brush means. As shown in FIG. 25.
E. Any other means which may be used for this purpose.

FIG. 8. Shows schematically the top view of the unit shown at FIG. 7. In this figure the end of the front piece of the re-useable handle means, 42 is attached to the body of a disposable brush means, 44 by use of a detachable attachment means, 46. Which allows the body of the dispoable brush means, 44 to be detached from the end of the handle means when desired. This figure shows relative sizes of these parts although they may vary in each part and directions.

FIGS. 9, 10 and 11. Show schematically three samples of special brush units that are designed for carrying a calculated amount of the dye in their body for being transferred for application on the hair. This method may use many different types of these units, however, in these views three examples are shown. For example the FIG. 9 shows the side view of a special brush unit, which has a body or stem shown at, 47 which has a series of walls around it. In this model the walls have a circular shape and go around the stem or the body of the brush unit shown at 47. One of these walls is shown at 49. The presence of two of these walls next to each other create a space between them, 50 that it will hold a pre-designed amount of dye inside them and also the dye attaches to the body of the brush unit, 47 and walls themselves. The free end of the brush unit has a round head, 48 so that it will not scratch the skin. Importantly, the surface and material of these units will be designed to have a calculated affinity for the dyes being used, so that this purpose will be achieved. For example the surfaces of these brush units may not be very glossy and in contrast may be made to be rough for promoting the attraction and temporary adhesion of the dyes to their surfaces.

FIG. 10. Shows schematically the side view of another brush unit, which has a body or stem that consists of combination of two separate stems, 51 and 52 with a distance between them, shown at 53. So that this space and adjacent stems will carry a predesigned amount of the dye. The free end of the brush unit also has a round head, 48 as well. Also importantly, the material and the structure of the surface of these stems will be also designed to have a desired temporary affinity for the dyes being used, so that this purpose will be achieved. For example the surfaces of these brush units may not be glossy and in contrast may be made to be rough with fine indentations and spaces for promoting the attraction and temporary attachment of the dyes to these surfaces. Also of importance is that the stems may parallel curves instead of being straight and they may be made with curves, angles, twists, bumps as shown in FIGS. 25, 26, 27, 28, 29, 30 and 32 for creating more spaces and surfaces for attracting more dyes on their body.

FIG. 11. Shows schematically the side view of yet other brush units, which has a body or stem 54 which is covered with a layer of absorbent material such as cotton shown at 55. Such a unit allows the following.

1. The brush unit may be immersed inside a pan of dye so that it will hold a predesigned amount of dye and will allow the dye to be delivered to the hairs.
2. Importantly, in a dry form it can be brushed thorough a series of hairs which are covered with a hair dye, to absorb some of the hair dye which comes in contact with the absorbent material, 55 during its passage among the hairs. Thus it will remove the dye from certain hairs or parts of the hairs and will prevent them from being dyed uniformly in order to create a differential coloring. The free end of this brush unit also has a round head, 48.

The following series of figures present examples of brushes that are modified in order to allow more capability for moving the dye to or from the hairs. One such model is shown at FIG. 25. In these models also the brush unit consists of a main body referred as 55, which is a rather flat body made from a relatively hard material such as metal or a polymer similar to the body of a commonly used hair brushes. This brush base is capable of holding a series of special brush units, 56 on its surface for being used almost like a commonly used brushes, except the brush units, 56 are specially designed for holding and carrying a predicted amount of the hair dye for dying the hair of humans and animals. The brush units may have any design or makeup, which will serve this purpose; also it may have any texture which may be used for coloring of the hair. Due to the affinity of the brush units to the dyes these brush units, may also be used for removing a noticeable amount of the hair dye which a person has already applied to the hairs.

These brush units may be made from the following make ups or means.

A. They may have a body made from a straight stem.

B. They may have a body made from shaped stem.

In the prototype unit, this brush unit may be made to be a straight stem except with having a round head designed to prevent from scratching the skin. However, importantly this brush is designed for use with a special dye pan which is specified in this application and shown in FIGS. 2, 4 and 5 and others. So that each brush unit will enter into a space which is designed for holding a specific amount of the dye for being carried to the hair. Thus, importantly, the numbers and the location and length of these brush units are chosen for such use and for fitting comfortably into the cylindrical spaces in the dye pan means. The base, 55 shown in this figure is removably connected to a handle, 1 by a connection piece, 57 at a connection point, 58. This method allows the end of a neck or connection piece, 57 for being inserted into the matching opening inside the base, 55 so that the handle can be removed and inserted into a new base after the use. Although this unit has a handle, 1 for holing the brush however, the unit may be made without the handle and the person will hold the unit by holding the base or its extension in one of its surface or another. Also the unit has a blade means, 4 in its end. The blade means is designed for swiping the dye from a small pan refereed as the dye pan, 7 in FIG. 2 into small specially designed cylindrical spaces, shown at same figure also at FIGS. 4 and 5. As explained in the text.

Note importantly, in the model shown in FIG. 25 the brush means is made from a series of brush units, 56 made from a stem with a zig, zag shape, creating an angular space in between its two adjacent bodies shown at 59. This design allows a calculated amount of hair dye to attach to the stem and the angular spaces between its bodies due to the viscosity of the hair dye, for being carried to the hair. Importantly, the brush unit may also have extra branches as shown in FIG. 29 at 64 and 65 and/or may also have buds in the body of the stem as shown in FIG. 32 at BUD, 69. This unit also has a handle, 1 for holing and also has a blade means, 4 in its end.

Importantly, as it was mentioned earlier, the material and the design of the surface of these stems and its components will provide a temporary affinity for the dyes being used, so that this purpose will be achieved. For example the surfaces of these brush units or its components may not be glossy and non-sticking, in contrast they may have a rough surface with fine or even microscopic indentations and spaces on their surfaces for promoting the attraction and temporary attachment of the dyes to these surfaces. Also importantly, the attachment of the handle means to the body of the brush means may be different for example the models shown at FIGS. 7 and 8 and similar may be used for allowing the attachment and detachment of these two pieces to occur.

FIG. 26. Shows schematically the side view of the unit shown on previous FIG. 25. In this view the brush unit is viewed in an axis parallel to the body of the brush units. Thus the body of the brush unit, 56 is viewed as a short straight line as shown at 56 while its round end tip will be viewed as a small circle shown at 40. The base of this unit is shown at 55, the handle shown at 1 and the connection point at 58.

FIG. 27 Shows a brush made from a series of brush units which have a stem with a spiral shape, creating spaces between its adjacent bodies, please also note the side view of this model at FIG. 28 This design also allows a calculated amount of hair dye to attach to the stem and may also make a wall or collection of dye in spaces between its adjacent bodies due to the viscosity of the hair dye, and proximity of two adjacent stem body. This unit also has a handle, 1 for holding and also has a blade means, 4 in its end.

FIG. 28 Shows schematically the side view of the unit shown on previous FIG. 27 In this view the brush unit is viewed from its head toward its base, thus the body of the brush Unit is being viewed almost as a circle shown at 61 while its round tip will be viewed as a Small circle shown at 48. The base of this unit is shown at 60, the handle is shown at 1.

FIG. 29. Shows schematically a brush unit with a stem with a zig, zag shape, similar to the unit shown at FIG. 25 which also has a series of angular spaces in between its two adjacent pieces which one of them is shown at 63. This unit also is fortified with a series of branches such as one shown at 64 and the 65. These branches are designed to increase the dye carrying capacity of the brush unit, since the surface and number of angles of the unit will increase. Importantly, the makeup of these branches may wary. For example the branch, 64 may be covered or made from an absorbent material such as cotton, with a higher degree of carrying or absorption capacity. The Branch, 65 has a body similar to the body of the stem except it functions to increase the overall surface of the unit and numbers of the angles.

FIG. 30. Shows schematically a brush unit similar to one shown in FIG. 27, this figure is to illustrate a brush unit which has a body made of a spiral stem, which in practice is a three dimensional unit. The body of stem may have further small branches for holding more dye as shown in 64 and 65 in FIG. 29. Importantly, the size, thickness, surface texture, the proximity or distances of the pieces of the body of all of these brush units and all other important characteristics of these brush units may vary in order to fulfill a special purpose and make a special unit.

FIG. 31. Shows schematically a brush unit which has a body made of a stem, 66 with a series of fibers, 67 attached to its body in different directions. So that these fibers will create multiple surfaces, areas, angulations and spaces around the stem which will make it able to attract or allow the attachment of a predicted amount of the dye. Since the dye attaches to the body of the stem and fibers also the proximity of these fibers will allow certain amount of the dye to attach to the stem and different fibers.

Importantly, note that these and other units explained in this text may be used for not only the application of the dye but also for the removal of the dye which was previously applied to the hairs. Importantly, please note that the size, numbers, directions, shape, thickness, surface texture, the proximity or the distances of these fibers and all other important characteristics of these brush units may vary.

FIG. 32. Shows schematically a brush unit which has a main body 68 made from a polymer with series of bumps or buds, 69 or extrusions on its surface, so that the presence of these buds will increase the surface and areas of the stem which will make it able to attract more amount of the dye. This unit also may be also used for not only the application of the dye but also for the removal of the applied dye on the hairs as well.

Importantly, please note that the size, thickness, shapes, surface texture, the proximity or the distances of the different parts of these units and all other important characteristics of these brush units may vary in order to fit a special use with a particular dye which may have different viscosity or manufacturing which will need a particular brush unit to carry or attract.

FIG. 33. Shows schematically the base of a brush means which has a central cushion made from means such as a rubber, 71 which acts as a cushion as well and is capable of holding the base of the brush units in order to provide a gentle brush means to be made in order to avoid roughness toward the skin of the users. Importantly, such a construction may be used with any of the brush means illustrated or explained in this application including the disposeable units and units which are shown in FIGS. 13, 15 and 18. Please note that this is a commonly used idea in many hair brushes available in the market.

Figure 12:
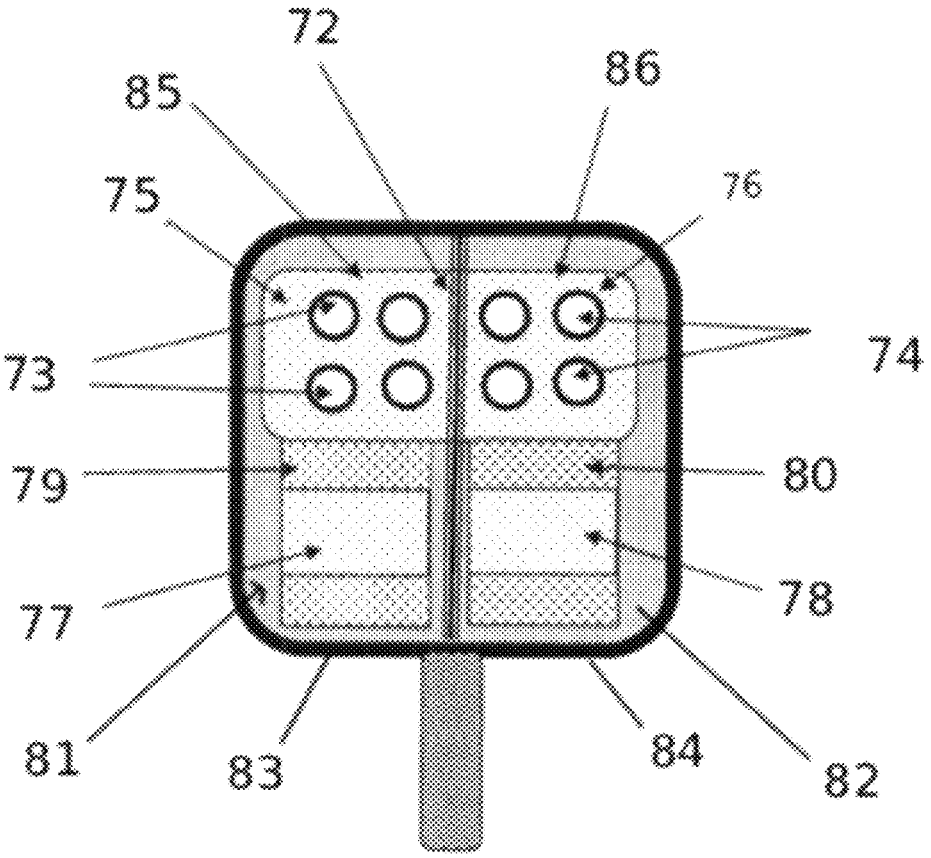
FIG. 12. Shows a tray means that consists of combination of two independent units for delivering different dyes.

FIG. 12. Shows schematically a tray means which is made to create combinations of two independent dye pans 85 and 86 for delivering two different dyes. This unit makes two relatively identical delivery system which are divided by a wall, 72. Each one of these units is similar to the dye delivery system shown at FIG. 2. Thus this unit has the following parts.

a. a series of cylindrical empty spaces, 73 and 74 designed to allow one brush unit, of a brush means similar to the unit shown at FIG. 1, 3, 7, 25, 27, 13, 15 and others if apply, to be inserted inside these cylindrical spaces and be immersed in the dye poured in these spaces. So that when the brush means is removed from the cylindrical spaces each brush unit will be covered with a special, predesigned amount of the hair dye. Thus the numbers of the cylindrical spaces, 73 and 74 will match the numbers of the brush units, from the brush means.

b. A first floors, such as 75 and 76 which are flat/horizontal surfaces which the cylindrical spaces 73 and 74 (which are vertical to the base) are attached to them and at the time of use these floors will be in a horizontal position and the cylindrical spaces with be vertical.

c. One side of each first floors has a pan for holding the dye, shown at 77 and 78, which function as a small pan and allows two different hair dyes to be emptied inside each one of these small pans.

d. A higher floor or a second floor shown at 81 and 82 which are flat surfaces which stand one level higher than the floor 75 and floor 76 and have their own surrounding walls; 83 and 84 which the walls 83 and 84 prevents from the dyes from leaving the pan means, similar to the unit shown at FIG. 2. Note at the time of use the second floors also will be in horizontal position and the walls 83 and 84 will be vertical.

e. Also there are ramps such as 79 and 80 for allowing the dyes to be swiped into the small clylindercal spaces, 73 and 74. The advantage of this unit is that it allows two different colors of hair dye to be placed in each separate side of this unit and to be utilized with.

At the time of use.

1. A brush that will be used once with first dye in 73 and then by use of the second dye in 74.

2. Or with a brush that has enough numbers of the brush units, properly located which will allow half of the brush units to be used with the first dye in 73 and the other half with the second dye in 74.

3. The brushes may have two blades for being placed in the sides in order to allow the wiping of the dye to be done easily in each side of this pan.

A first floors, such as 75 and 76 are flat surfaces that the cylindrical spaces 73 and 74 are attached to them and at the time of use these floors will be in a horizontal positions. The ramps and the other parts will mimic the unit shown at FIG. 2. Note, the use of two dyes with different colors will allow two colors and shades of these two colors to be applied to the hairs and create differential coloring. Importantly, more than two colors may be used with utilizing this method and the main teachings, such as having three or more sets of pans, floors or ramps etc. Also importantly, the size of these two areas may not be similar and they may vary in order to accept different numbers of the brushes for each side to be used.

FIG. 13. Show schematically a disposable body of brush means that is designed for use with a re-useable handle means shown at FIG. 14. In this model the body of the brush means, 87 is made of a hollow unit such as a rectangular cuboid made from a relatively rigid means that holds a series of brush units, 88 on its upper and lower surfaces. This will be similar to the outer part of match box except has a front wall too with a relative size of 2.5 wide and 3.5 inches long with side wall of 0.5 by 3.5 inches. This unit allows a re-useable handle means, shown at FIG. 14 to be inserted inside the hollow center part of this unit in order to be functional. This re-useable handle means shown at FIG. 14 has an insert part, 89 which matches the size and shape of the hollow center part of the unit shown at FIG. 13 and will fit inside the inner hollow space of that unit to make a functional unit. The insert has a rectangular, cube shape with relative sizes of a touch less than 0.5×2.5×3.5 inches so that it will fit inside the boy of the brush means 87. The tip of the insert part, 89 will be pushed into the opening, 90 of the unit shown at FIG. 13. The sides of the body of the brush means, 87 has clip means, 91 designed to engage with the zone between the neck, 92 and the body of the insert, 89, from the handle means shown at FIG. 14. This engagement will keep the disposable piece in place during the use until the user decides to remove the disposable piece by holding the handle 93 by one hand and pulling the body of the brush 87 by use of holding the end piece 94 designed for this purpose. The piece 94 may be modified to function as blade as well. This is one of the methods presented in this application which allows the user to use a disposable brush means for the delivery and removal of the dye on the hair. Importantly, note one group of the brush means shown in first side here may be used for the delivery of the dye and the group from the second side of this brush means may be used for the removal of the dye if so desired. Importantly, the unit may have four sides covered with the brush means. Also importantly, the makeup of the brush means in first surface of this unit may be different than the brush means on the second surface for example referring to the FIGS. 9-11 one series of the brush units shown in FIG. 9 to be on the upper surface of the unit shown in FIG. 13 and another series of the units shown at FIG. 11 on the lower surface to allow first series to be used one time and the second series to be used afterward. Also it can be the same as other brush units shown in other figures such as 25, 26, 27, 28, 29, 30, 31, 32 and 33. So that the user can use one surface for one reason and the other surface for other reason whatever the uses may be. For example the side with brush unit with FIG. 9 for application of the hair dye and side with brush unit with FIG. 11 for the removal of the hair dye applied on the hair.

FIG. 14. Shows schematically the side view of the body of a handle means, which consist of an insert piece, 89 designed to match the inner shape and size of the body of the hollow inner space of the body of the brush means shown at FIG. 13 so that this unit can be inserted inside the hollow center of that unit. The insert, 89 is connected to a neck piece, 92 which the front end of the neck will engage with the 91 of the unit shown at FIG. 13 in order to keep these two units attached and in place. The other end of the neck piece, 92 is attached to the handle means, 93. So that with the insertion of the insert inside the body of brush the combination will make a complete brush unit with a reusable insert and a disposable brush means and to be functional. After the use the insert will be removed from the body of the Brush and it will be ready for use with a new body of the brush unit and the used body of the brush will be disposed.

FIG. 15. Shows schematically the cross cut side view of the body of the disposable brush means, 87 similar to one shown in FIG. 13. In this figure the body of the brush means, 87 is shown with its hollow opening for the insert, 90 which will accept and hold the insert, 89 part of the handle means, shown at FIGS. 14 and 16 for making a useable unit. This figure shows a series of brush units, 88 which are attached to the upper and lower surfaces of this unit. It also shows a blade means 95 which instead of being in front of this unit is attached to its side.

FIG. 16. Shows schematically the top view of a re-useable handle means, shown at FIG. 14. In this figure, the insert part is shown at, 89 the handle part is shown at, 93 and the neck, 92 between them. This unit is designed to be used with units such as one shown in FIGS. 13, and 15.

FIG. 17. Shows schematically a modified, disposable brush means for use with the dye pan shown at FIG. 12. In this model the body of the brush means also has a hollow body similar to the unit shown at FIGS., 13 and 15. and uses a matching handle means similar to the unit shown at FIGS. 14 and 16 to make it functional. The body of this unit is shown at, 96 which is made of a box shaped body, made from a relatively rigid means which holds a series of brush units, 97 and brush units, 98 on its surface. Per design, when used with pan shown at FIG. 12. The brush units, 97 are capable of carrying different dye than the group shown at 98. This unit may also have two blade means, 99 and 100, for use with the dye-pan 77 and dye-pan 78 from the unit shown at FIG. 12.

FIG. 18. Shows schematically a disposable brush means, similar to the model shown at FIG. 13 except it has two different brush units, 102 and 103 which are different than each other, for example the upper surface of this brush means unit 101 has brush units 102 similar to the units shown at FIG. 11 but the lower surface has brush units similar to the brush unit 103 shown at FIG. 9. So that there will be option of using different brush units with one brush means. In this figure the body of the brush means, 101 is shown with its hollow opening 104 for the insert which will accept and hold the insert, 89 part of the handle means, shown at FIGS. 14 and 16 for making a useable unit. The clip means is shown at 105. Thus importantly, the brush means may have one model of the brush units chosen from one of the models shown in this application as shown in FIGS., 9, 10, 11, 25, 26, 27, 28, 29, 30, 31, 32 and 33 on its first surface and another model of brush units as shown in those figures on its second surface. Also importantly, the brush means may have more than two surfaces such as three or four or more with different brush units on its different surfaces for more options. yyyNnn 11-22-14

Methods of Use of these Units.

The use of the above mentioned units follows the following basic directions.

1. Initially, the user places the disposable pan means, shown at FIG. 5 inside the durable pan means shown at FIG. 4. And close the cover of the handle, 16.
2. The user pours the hair dye inside the dye pan, 7 and mixes with the developer or similar if needed until the dye is ready for use.
3. The user uses the blade 4 of a brush means such as one shown at FIG. 3 and swipes the hair dye from the 7 up to the floor, 21 for filling the cylindrical spaces, 22. The user will choose a reasonable amount of the dye so that there will not be too much dye above the 22. Note importantly, an independent blade means may be used for this purpose.
4. The user places the brush means shown at FIG. 3 or preferably, the units shown at FIG. 7-8 or 13-15 inside the cylindrical spaces, 22 so that the brush units, 3 of these brush means will immerse into the dye in order for holding a designated amount of the dye in their bodies.
5. The user will use the brush means with its brush units covered with dye for brushing and coloring the hairs. Importantly, since each brush unit, 3 carries only a predesigned amount of the hair dye, thus per design the hair dye with a calculated viscosity will not spill from the brush means, and will not contaminate the surroundings. By repeating this step the user will be able to dye the hairs, in a fashion which he or she wants. Importantly, since per design there are spaces between the brush units, therefore, some of the hairs will not be colored and this will create differential coloring. Importantly, the sizes, consistencies, components, the relative sizes of the brush, brush units and the dye pans and every other important parameters of these units may vary in order to fit a given use and option.
6. Importantly, with the use of a dry brush means, particularly, those made with an absorbent materials such as the brush unit, 55 shown at FIG. 11, the user will be able to remove lines of the hair dye which are already applied to the hair. Thus creating a series of hairs that some part of them does not have the hair dye. Thus the coloring of the hair will not be uniform.
7. At the end, the user removes the disposable brush means, shown at FIGS. 7-8 and 13-15 and the disposable insert of the pan means shown at FIG. 5 and disposes. This will leave the durable dye pan shown at FIG. 4 and the handle of the brush means similar to the unit shown at FIGS. 14 and 16 clean and ready for next use.

The use of the dye delivery pan with two different sets of the dye delivery systems as shown at FIG. 12 will be very similar to the process mentioned except the user will use the dye from first or the second sets of the dye pans or simultaneously, in the way they want using one dye and mixing the other dye periodically as they wish.

SOME MORE EXPLANATION OF THIS INVENTION

This application introduces a method and means which allows differential coloring of the hairs. This goal can be achieved by two methods.

1. In first method, the person uses a hand hold brush means, shown at FIG. 1. That allows a predicted amount of hair dye to be carried to the hair for application. This brush means, has a series of brush units, 3 that are capable of holding a predicted amount of the hair dye for being taken and for being applied to the hairs. This method has the following advantages.

A. It allows the application of the dye to the hair to be easy.

B. It allows some groups of the hairs to be spared from being dyed. Since there is a space between the brush units, 3.

2. In second method the applicant uses a dry brush means, in order to remove some of the hair dye which was already applied to the hairs. For this purpose the brush means, has a body made with brush means 55, shown at FIG. 11. When this brush means is used in a dry condition the absorbent body 55 will remove the dye which is applied on the hair during its journey through the hairs. Thus the hairs in course of the journey of this brush means will have no or lesser amount of the dye. With enough application finally the hairs will have different groups, some which has received almost full dose of the hair dyes and others with much lesser hair dye and a third group which has different shades of the hair dye on them. Thus at the end this method creates hairs with shades of the hair dye on them and to look different than having a universal coloring.

The brush means consists as follows.

1. It has a base, 2 made from a rigid material such as wood, metal or a polymer, or any man made materials which holds a series of special brush units, 3 on it. The unit has a handle, 1 for holding it and also a blade, 4 in its end. The blade is for wiping a dye into special small space. The function of the brush means is as follows.

A. At the time of use, this brush means will be placed inside a pan with dye in a level that the dye reaches only till the base of the brush units, 3. This makes the body of the brush units to hold a predicted amount of dye so that the dye can be taken and delivered to the hairs. Thus per design, using this method will prevent the hair dye from dripping and contamination of the surrounding. Since the consistency of the dye and the calculated surface area or the porous nature of the brush units, 3 the dye amount on the brush unit, 3 will not allow the dye to drip. Thus the application of the dye to the hairs will be easier, without dripping and messing the surrounding area. The removal of the dye with each application will reduce the level of the dye on a regular flat pan to a level that at some point the level of the dye on the pan will be so low that only it will be enough to reach the tip of the brush units, 3. To prevent such a phenomenon the applicant introduces a special pan means shown at FIGS. 2, 4 and 5 and similar that allows a consistent amount of the dye to be delivered by this brush means, each time, until the very last use. This prevents from wasting the dye as well. Thus over all a lesser amount of dye will be used, this will be a lot of saving and will prevent from a lot of wasting and environmental problems as well.

B. By this method each 3 will carry the hair dye to some distance around the brush units, 3, thus with choosing a proper distance between the brush units, 3 then, some groups of the hairs will be spared from being dyed. This allows hairs with two different colors and shades in between.

C. By using a new brush means covered with the absorbent material around its brush units, 55 as shown in FIG. 11, or any brush unit multiple times, each time with a new brush means, each time. This will function such that it will remove some of the hair dye which has already been applied to the hairs, during the passage of the brush means among the hairs. Thus by multiple application of such a unit in dry condition, finally the hairs will have different groups, some which has received full dose of the hair dyes and others with much lesser hair dye and a third group which has different shades of the hair dye on them. With mixing them a natural look will appear and a universal coloring will be prevented. Importantly, the other models of brushes with different brush units introduced in this application will be also capable of removing some of the dye from the hairs when used dry and without dye on them.

FIG. 2. Shows schematically a pan means, designed to simplify and facilitate the process of the carrying of the hair dye to the hairs and prevent from contamination of the unwanted areas. Also importantly, this unit allows the least amount of the dye to be used for dying the hairs, since the last amount of the dye will be used by being filled in the cylindrical spaces. FIGS. 3, 4 and 5 are designed to show units of a complete system for use by this method. FIG. 3. Shows schematically a brush means similar to the unit shown at FIG. 1 which matches the dye delivery tray means, shown at FIG. 4. In this unit the size, the location, the distances between the brush units, 3, the numbers of the brush units, 3 all are designed to allow this brush means to fit inside the tray means shown at FIG. 4. FIG. 5 shows a disposable, insert made from a thin synthetic material that matches and simply will fits inside the cradle means shown at FIG. 4. Thus naturally the shape and the buildup of this unit will match to allow such use. The idea behind the use of this insert is as follows.

1. Eliminating the need for washing the unit. By removing and disposing the insert, the user does not need to waste water and time for washing the whole cradle unit shown at FIG. 4. Since such cleaning will be a very demanding job.
2. This makes these units economical, since a thin disposable piece will be cheaper and affordable. There will be no need to waste water, contaminate sewage system etc.
3. This makes these units clean and hygienic, when it is used in barber shops, since the thin disposable piece will be disposed after each use, thus it will eliminate or very significantly, decrease the chance of spread of germs.
4. In barber shops, it will provide piece of mind to the users when they know that a new units is used for them alone.

Using the logics, there is not much explanation needed for the shape of these inserts since Their body and shape simply will match the inside surface of the durable unit shown at FIG. 4 and this piece will simply fit inside it. The edges of the upper side walls of the insert will overlap the side walls of the durable unit so that it will prevent from the contamination of the side walls of the durable unit. The unit may have a handle cover, for going over the handle of the durable unit to prevent it from contamination. The handle cover means has a door means hinged to it at, Hinge that will cover the lower surface of the handle and snap to its own wall, so that the handle part will be covered totally. Alternatively, a thin vinyl envelope or a sleeve shown in FIG. 24 may be used for being pulled over the handle for preventing from its contamination.

Importantly, please note that although the use of only one brush unit, 3 of the brush means shown at FIG. 1 is emphasized for being inserted inside only one of these cylindrical spaces however, one may choose to have two or more brush units adjacent to each other in order for being immersed inside the one larger cylindrical space, 5 in order for being covered with the dye. Thus in practice those two of three brush units will in fact function as a single unit for this purpose. Importantly, the brush unit shown at FIG. 10 has two stems going to one cylindrical space, 5 except it has one round heard, 48 however, it is easy to consider that each one stem may have its own round head as well or the brush unit to have three or more stems which will inter into one cylindrical space, 5. Importantly, please note that this idea can also apply in any other brush means as well.

FIGS. 6 and 19 show a simple divided pan which may be used for creation of small spaces. This unit shows that the pan means may be made in a different shape as well. The FIG. 6 shows schematically the top view of a dye pan means, 25 with small spaces created by dividing a pan by walls, 26. FIG. 19 shows schematically the cross cut view of the dye pan means, 25 shown in previous FIG. 6.

Importantly, the size, width, length and depth of this pan will be chosen to fit the matching brush means so that the placement of a matching brush means with this pan will allow a predesigned amount of hair dye to be taken away for use.

FIG. 24 shows schematically a thin vinyl envelope or a sleeve which is designed in order for being pulled over the handles of the units shown in FIG. 2, 4, 21 or similar in order to prevent them from contamination FIGS. 7, 8, 14 and 15 are designed to show a method which allows a disposable brush means to be used with re-useable handle means in order to be economical and advantageous. In this method the re-useable handle means will be connected, attached or inserted to the body of a disposable brush means by various means. So that after use the disposable brush means can be disconnected from the handle means for disposal and the handle means will be used again with a new disposable brush means. The advantage of this method is that it allows lesser amount of the materials to be wasted and has other advantages which have been explained in the text.

The models shown at FIGS. 13, 14 and 15. The brush means has a body with a double sided surface that allows the brush units to be located on its top and lower surfaces. This system allows a handle means to be inserted inside the body of the brush means. Importantly, the body of the brush means may be made to have three or four sides or more with brush means. It may be even made to be cylinder or any other useful shape and models so that more than one surface may be used without need to change the disposable piece.

FIG. 9. Shows schematically the side view of single, special brush units, which has a body or a stem shown at, 47 with a series of short, circular walls, 49 which are located around the stem, 47 and are perpendicular to it. The presence of walls close to each other creates spaces between them, 50 so that by this design it will hold a pre-designed amount of dye on it because of the consistency of the dye. The free end of the brush unit, has a rounded head, 48 so that it will not scratch the skin.

Importantly, instead of the walls the stem may be made to have other means such as.

a. Short, multiple side branches.
b. Spikes.
c. Indentations
d. Holes and or openings.
e. Spaces.
f. In the shape of spirals.
g. Having branches.
H. Having filaments or fibers attached to them.
I. Any other means which increases the surface of the stem and modify its surface to allow a temporary attachment of the dye to the stem or brush units and their parts and the surfaces for delivery to the intended area.

Importantly, any other means and modification which may be useful for this purpose may be used for making such units when applicable.

Method of application of two dyes simultaneously. In this model a dye pan means similar
to the model shown at FIG. 12 will be used and then.
1. A brash that will be used once with first dye in 73 and then by the second dye in 78. 2. Or with a brash that has enough numbers of the brush units, 3 that will allow half of the brush units to be used with the first dye in 73 and the other half with the second dye in 74. A model of such brush means is shown at FIG. 17.

Importantly, the brush means may have their own blades, located at the ends or sides of the brush means or may use a separate and independent blade means for this purpose. The use of two dyes with different colors will allow two colors and shades of these two colors to be applied to the hairs and prevent from a uniform coloring. Importantly, more than two colors may be used with utilizing this method.

Importantly the size, thickness, nature of the brush units, relative sizes and the distances between the brush units, the materials and other important parts of these units may vary in order to make different useful units. The modification of this invention can be done to make it useful for other purposes and uses, other than the hair coloring as well.

Importantly, please note in this application different options of a complete unit may be shown in separate Figs. to prevent a confusing figure, for example the rubber cushion is shown alone although it will be used with the brush units attached to it and similar. Thus please note this important issue.

The invention claimed is:

1. The combination of a brush for applying hair dye to hair, and a dye-holding pan, the brush comprising a brush base and multiple dye-holding units disposed on the brush base in a pattern comprising multiple side-by-side rows with each row comprising multiple dye-holding units;

the dye-holding pan comprising multiple open-top receptacles for holding hair dye arranged in a pattern comprising multiple side-by-side rows with each row comprising multiple receptacles arranged in a pattern that allows the dye-holding units of the brush to be inserted into the receptacles to acquire dye on a basis of only one dye-holding unit to one receptacle, the pan comprising a base which contains the receptacles, the pan having a margin which surrounds the receptacles.

2. A brush and pan as set forth in claim 1 in which the pan comprises two sets of receptacles and two dye-holding portions, and a dividing wall which separates one of the sets of receptacles and one of the dye-holding portions which is associated with the one set of receptacles from the other of the sets of receptacles and the other dye-holding portion.

3. A brush and pan as set forth in claim 1 further comprising disposable dye-holding pan liner receptacles which line the pan receptacles in the pan base.

4. A brush and pan as set forth in claim 3 in which the disposable dye-holding pan liner receptacles are contained in a liner element which fits to the pan base.

5. A brush and pan as set forth in claim 4 in which the brush further comprises a brush handle which extends from the brush base and the pan comprises a pan handle which can be grasped by a person's hand for holding the pan and which extends from the pan.

6. A brush and pan as set forth in claim 4 in which the liner element has a margin overlying the margin of the pan.

7. A brush and pan as set forth in claim 1 in which the brush comprises a brush handle which separably attaches to the brush base.

8. A brush and pan as set forth in claim 7 in which the brush base is arranged to slide onto and off of a portion of the brush handle to allow the brush base and its dye-holding units to be removed and replaced by a fresh brush base and its dye-holding units.

9. A brush and pan as set forth in claim 8 in which the brush comprises at least a first set of dye-holding units extending in a first direction away from the brush base and a second set of dye-holding units extending away from the brush base in a second direction different from the first direction.

10. A brush and pan as set forth in claim 9 in which the dye-holding units of the first set are structurally different from the dye-holding units of the second set.

11. A brush and pan as set forth in claim 7 in which the brush handle separably attaches to a surface of the brush base which is opposite a surface from which the dye-holding units extend.

12. A brush and pan as set forth in claim 1 in which at least one dye-holding unit disposed on the brush base comprises a wall having a hollow interior and at least one aperture for allowing dye to be enter and exit the hollow interior through the at least one aperture.

13. A brush and pan as set forth in claim 1 in which the pan has a surface containing the open tops of the receptacles, and the outer margin of the pan comprises a perimeter side wall which is spaced outward from, and extends upward from, the surface containing the open tops of the receptacles.

14. A brush and pan as set forth in claim 13 in which the perimeter side wall comprises a first floor which extends outwardly from the surface containing the open tops of the receptacles and a second floor which is above and outwardly of the first floor.

15. A brush and pan as set forth in claim 14 in which the perimeter side wall of the pan includes a wall which extends upward from the first floor to join with the second floor.

16. A brush and pan as set forth in claim 15 in which the perimeter side wall of the pan includes a wall which extends upward from the second floor.

17. A brush and pan as set forth in claim 1 in which the pan has a planar surface which contains the open tops of the receptacles, and a dye-holding portion including a ramp which inclines downward from the planar surface into the dye-holding portion.

18. A brush and pan as set forth in claim 17 further comprising a liner element which lines the dye-holding portion, the ramp, the planar surface, and the receptacles.

19. A brush and pan as set forth in claim 1 in which at least one dye-holding unit disposed on the brush base comprises a rounded tip end opposite the brush base.

20. The combination of a brush for applying hair dye to hair, and a dye-holding pan, the brush comprising a brush base and multiple dye-holding units disposed on the brush base in a pattern comprising multiple side-by-side rows with each row comprising multiple dye-holding units;

the dye-holding pan comprising multiple open-top receptacles for holding hair dye arranged in a pattern comprising multiple side-by-side rows with each row comprising multiple receptacles arranged in a pattern that allows the dye-holding units of the brush to be inserted into the receptacles to acquire dye on a basis of only one dye-holding unit to one receptacle, the pan comprising a base which contains the receptacles, the pan having a upwardly extending wall which surrounds the receptacles.

21. A brush and pan as set forth in claim 20 further comprising disposable dye-holding pan liner receptacles which line the pan receptacles in the pan base.

* * * * *